US008523214B2

(12) United States Patent
Johansson et al.

(10) Patent No.: US 8,523,214 B2
(45) Date of Patent: Sep. 3, 2013

(54) MOBILE ROCKING PATIENT CHAIR AND METHOD OF USE

(76) Inventors: Paul J. Johansson, Fort Lauderdale, FL (US); Paul David Johansson, Fort Lauderdale, FL (US)

( * ) Notice: Subject to any disclaimer, the term of this patent is extended or adjusted under 35 U.S.C. 154(b) by 67 days.

(21) Appl. No.: 13/251,274

(22) Filed: Oct. 2, 2011

(65) Prior Publication Data

US 2012/0292878 A1 Nov. 22, 2012

Related U.S. Application Data

(60) Provisional application No. 61/487,113, filed on May 17, 2011.

(51) Int. Cl.
*A61G 5/10* (2006.01)
*A63B 21/00* (2006.01)

(52) U.S. Cl.
USPC ..... 280/304.1; 297/258.1

(58) Field of Classification Search
USPC ..... 280/304.1, 250.1, 30; 297/20, 131–133, 297/258.1, 259.1, 270.1, 272.1, 423.43
See application file for complete search history.

(56) References Cited

U.S. PATENT DOCUMENTS

| | | | | |
|---|---|---|---|---|
| 383,808 | A | | 5/1888 | Hall |
| 482,167 | A | | 9/1892 | Dennett |
| 1,544,187 | A | | 6/1925 | Schroeder |
| 2,283,000 | A | | 5/1942 | Feldman |
| 2,302,387 | A | | 11/1942 | Greeno et al. |
| 2,541,955 | A | * | 2/1951 | Booth ..... 280/43.15 |
| 2,653,649 | A | | 9/1953 | Linquist |
| 2,815,067 | A | | 12/1957 | Richardson |
| 3,134,627 | A | | 5/1964 | Mason |
| 3,455,600 | A | | 7/1969 | Secor et al. |
| 4,054,317 | A | | 10/1977 | Stumpf |
| 4,108,415 | A | | 8/1978 | Hauray et al. |
| 4,536,029 | A | | 8/1985 | Rogers, Jr. |
| 4,641,848 | A | | 2/1987 | Ayers |
| 4,679,862 | A | | 7/1987 | Luo |
| 4,786,106 | A | | 11/1988 | Bottemiller |
| 4,832,357 | A | | 5/1989 | Crew |
| 4,837,876 | A | | 6/1989 | Levy |
| 4,869,494 | A | | 9/1989 | Lambert, Sr. |
| 5,002,144 | A | | 3/1991 | McMahon |
| 5,004,259 | A | | 4/1991 | Ayers et al. |
| 5,020,817 | A | | 6/1991 | Leib |
| 5,099,528 | A | | 3/1992 | Wadman |
| 5,110,183 | A | | 5/1992 | Jeanes, III |
| D328,831 | S | | 8/1992 | Wojcik |
| 5,249,640 | A | | 10/1993 | Grove |
| 5,294,141 | A | | 3/1994 | Mentessi et al. |
| 5,572,903 | A | | 11/1996 | Lee |

(Continued)

*Primary Examiner* — Tony Winner
(74) *Attorney, Agent, or Firm* — The Concept Law Group, P.A.; Scott D. Smiley; Mark C. Johnson

(57) ABSTRACT

A mobile patient chair includes a seat portion and an undercarriage coupled to and supporting the seat portion, where the undercarriage includes a frame having a set of rollers and a rocking mechanism coupling the seat portion to the frame. The chair has a rolling mode, whereby the set of rollers rotate and allow the mobile patient chair to move from a first location to a second location and a rocking mode, whereby the rocking mechanism is operable to move the seat in a substantially forward and backward translating movement relative to the frame. A lockout member renders the rolling mode and the rocking mode mutually exclusive.

19 Claims, 25 Drawing Sheets

(56) References Cited

U.S. PATENT DOCUMENTS

| | | | |
|---|---|---|---|
| 5,803,885 | A | 9/1998 | Tiller |
| 5,897,462 | A | 4/1999 | St. Germain |
| 5,937,961 | A | 8/1999 | Davidson |
| 5,976,097 | A | 11/1999 | Jensen |
| 6,089,584 | A | 7/2000 | Cobb |
| 6,161,847 | A | 12/2000 | Howell et al. |
| 6,206,393 | B1 | 3/2001 | Mascari et al. |
| 6,250,654 | B1 | 6/2001 | Willis |
| 6,257,609 | B1 | 7/2001 | O'Neill, Sr. |
| 6,406,095 | B1 | 6/2002 | Bouchard et al. |
| 6,547,206 | B1 | 4/2003 | Dickie |
| 6,588,527 | B2 | 7/2003 | Lerner et al. |
| 6,793,229 | B1 | 9/2004 | Nadal |
| 7,014,204 | B2 | 3/2006 | Meyers et al. |
| 7,100,724 | B2 | 9/2006 | Haigh |
| 7,243,935 | B2 | 7/2007 | Beumer |

* cited by examiner

2400

2400

MOBILE ROCKING PATIENT CHAIR AND METHOD OF USE

CROSS REFERENCE TO RELATED APPLICATION

This application claims the benefit of U.S. Provisional Application No. 61/487,113, filed on May 17, 2011, the prior application being herewith incorporated by reference in its entirety.

FIELD OF THE INVENTION

The present invention relates generally to wheeled, movable chairs, and, more particularly, relates to a movable chair with rocking and other capabilities.

BACKGROUND OF THE INVENTION

Although rocking is a part of virtually every human's childhood, much more often than not, it becomes an infrequent activity in the adult years. This is largely due to the fact that few people are aware of the myriad benefits conveyed by the rocking movement on the body.

Historically, rocking chairs have been a considered a treasured piece of furniture. Originating in England, by the 1700s, rocky chairs had become an American phenomenon. A common and functional piece of furniture, rocking chairs were used in virtually every home. In addition to soothing emotional wounds and providing comfort in times of illness, rocking chairs were widely accepted as a cradling device, ensuring the emotional bond between mother and child.

Through scientific research and case studies, today, society is discovering the therapeutic and life-changing effects rocking chairs have on psychosocial well-being, among other types. The use of rocking chairs has spread far beyond the mother/child cradle—they are now considered a cure for a wide range of health problems.

Studies have shown that the gentle motion of a rocking chair releases endorphins; a chemical known to improve mood and lessen pain. The study confirms that rocking chair therapy increases the quality of life for people suffering from Dementia and Alzheimer's disease. Studies further show that the calming movement of a rocking chair can dramatically speed up the healing process in severely ill patients. Not surprisingly, rocking chairs are now being used as therapy for post-surgery recovery.

Unlike other pieces of furniture and medical devices, rocking chairs provide a place for rest and relaxation with both psychological and physical benefits. They have been scientifically proven to be of benefit for many medical conditions. By working the muscles and tendons of the thighs, lower legs and ankles, studies have revealed that rocking chairs provide light to moderate exercise, even for those with limited mobility. They contribute to fitness and assist in maintaining or losing weight. Only five to ten minutes of rocking per day can reduce blood pressure and improve circulation. Rocking chairs have also been shown to reduce the impact of diseases such as arthritis, assist in the promotion of prenatal nervous system development, progress healing after surgery, positively impact the immune system, and improve the quality of living by rejuvenating the mind.

Some studies indicate that rocking has been linked to improved cognitive conditions such as Alzheimer's disease, and sensory disorders including autism. Researchers believe that the motion of rocking satisfies the autistic individual's need to keep moving, while allowing them to concentrate and study.

Rocking Chair Therapy appears to ease health problems, and it has been applied and proven beneficial to at least the following conditions:

1. Abdominal hysterectomy pain: Rocking chairs have been proven helpful for people with abdominal hysterectomy pain. Studies have suggested that the back and forth motion of rocking helps relieve intestinal gas buildup and abdominal distension. Researchers have hypothesized that the rhythmic repetitive motion of rocking stimulates the vestibular nerves and has a modulating effect on the stress response.
2. Anxiety and depression: It has been reported that the act of rocking improves anxiety and depression in people suffering from Alzheimer, dementia, ADHD, Autism and sensory disorders. Rocking chair therapy has also been shown to have a positive effect on the emotional well-being of dementia patients in nursing homes. In addition to reducing anxiety, depression and medication consumption, patients' balance tends to improve, resulting in fewer subsequent falls and related injuries.
3. Arthritis: Experts highly recommend the use of rocking chairs. According to studies, rocking is relaxing and can improve strength and flexibility, especially in a person's knees.
4. Back pain: President John F. Kennedy is often credited for the worldwide acceptance of rocking chair therapy. After being diagnosed and suffering from extreme back pain, Kennedy's physician prescribed him a rocking chair. Amazed by the healing effects of the rocker, Kennedy insisted that the chair accompany him to the White House after his presidential election. Over the years, Kennedy had at least 14 rocking chairs, some of which were kept in the most exclusive locations including, the Oval Office, his bedroom at the White House, a suite at the New York Carlyle's Hotel, and Air Force One. Today, research studies have confirmed that rocking chairs block pain impulses, relax the muscles in the lower back, and ease lower back pain.
5. Blood pressure: In a pilot study of men and women over 55 who often suffer from lower blood pressure and low blood return to the brain, 30 min of steady rocking led to an average 12 mmHg increase in systolic blood pressure and a 3.6 average increase in diastolic blood pressure. Rocking tends to increase blood pressure, which in turn helps get blood to the brain.
6. Cardio vascular issues: Rocking chairs are an excellent source for cardio vascular training. To improve upper body training, accessories or training devices can be attached to the chairs.
7. Children with ADHD and other disorders: There is gathering anecdotal evidence for the benefits of allowing children with Attention Deficit Hyperactivity Disorder to use a rocking chair while reading. ADHD cases appear to be able to concentrate better when rocking chair therapy is used. It is believed that the rocking motion gives an outlet to excess energy.
8. Chronic fatigue, stroke and heart attack: Rocking in a rocking chair has been proven beneficial for chronic fatigue, stroke and heart attack victims.
9. Fragile X syndrome: Fragile X is a family of genetic conditions which impacts individuals and families in different ways. Fragile X Syndrome is the most common form of inherited mental impairment and is sometimes referred to as mental retardation. Sensory impairment or sensory processing difficulties are often a part of the puzzle. Rocking in a rocking chair is a recommended part of the therapy, cited for its calming effects.

10. Sensory integration therapy: SIT is a theory used by occupational therapists and has been applied to autism learning disabilities, attention problems, and developmental problems including Fragile X. Rocking in a rocking chair is one of the calming activities that is recommended. The late A. Jean Ayres, PhD. developed the theory and practice of sensory integration. She believed every autistic child should have a rocker in his room.
11. Sleep: For children, rocking chairs assist in getting them to sleep and reduce the odds of apnea and Sudden Infant Death Syndrome (SIDS). For adults, it is believed that rocking chairs release tension, similarly aiding them in sleep.
12. Strength and flexibility: According to the results of study groups, strength and flexibility increase in patients who use rocking chairs as a form of therapy.
13. Surgical healing process: A recent study found that short periods of regular rocking chair therapy speed recovery from bowel dysfunction, a common side effect of abdominal surgery for colon, small bowel, pancreatic and liver cancers. Patients who spent time rocking in a rocking chair resumed bowel activity more quickly than patients who did not, which meant they felt better sooner and recovered faster.

Rocking in a Rocking Chair has also been proven helpful for women after a C-section. One study found that rocking mothers who had cesarean sections had less gas pains, walked faster, and left the hospital one day sooner than non-rocking mothers. This could explain why rockers are a standard in maternity wards today.
14. Stuttering: Rocking chairs are recommended for children who stutter. The distracting rhythm works on vestibular function.
15. Varicose veins: Rocking chairs have been linked to the prevention and cure of varicose veins. According to the research, rocking stimulates circulation and improves muscle tone, thereby reducing and preventing the development of varicose veins.
16. Weight loss: Rocking chairs have proven to be successful in the maintenance and reduction of weight. In fact, rocking in a rocking chair burns approximately 150 calories per hour.

Unfortunately, at a time when people need rocking the most—when they are immobilized—they are deprived of the ability to rock. For example, when persons reach an advanced age, they are often times confined to a wheel chair and are unable to rock. Once such improvement to the art is described in U.S. Pat. No. 4,707,026, which was issued to one of the co-inventors of the instant application, the entire disclosure of which is incorporated herein by reference. The device described in U.S. Pat. No. 4,707,026 however lacks several important features that render a mobile patient rocking chair suitable for everyday use.

Therefore, a need exists to overcome the problems with the prior art as discussed above.

SUMMARY OF THE INVENTION

The invention provides a mobile rocking patient chair and method of use that overcomes the hereinafore-mentioned disadvantages of the heretofore-known devices and methods of this general type and that allows a patient to be mobile and enjoy the ability to rock in a rocking chair.

With the foregoing and other objects in view, there is provided, in accordance with the invention, a patient chair that includes a seat portion and an undercarriage coupled to and supporting the seat portion, where the undercarriage includes a frame, a rocking mechanism coupling the seat portion to the frame, a selectively pivotable pivot arm coupled to the frame, and at least one wheelchair-type wheel selectively couplable to the pivotable pivot arm.

In accordance with another feature, an embodiment of the present invention includes a set of wheels coupled to the frame that operable to reduce friction between the frame and a flooring surface upon which the patient chair is supported. In other words, the wheels allow the frame to glide across the floor.

In accordance with a further feature of the present invention, the set of wheels provides mobility and stability to the patient chair independent of a coupled/decoupled state of the wheelchair-type wheels.

In accordance with a further feature of the present invention, the pivot arm further includes a wheel-coupling end, a pivot-arm manipulating end, and a pivot point located between the wheel-coupling end and the pivot-arm manipulating end.

In accordance with yet another feature of the present invention, a bias member biases the wheel-coupling end of the pivot arm in a downward direction.

In accordance with an additional feature of the present invention, the pivot arm is arranged on the frame so that movement of the pivot-arm manipulating end moves a wheelchair-type wheel coupled to the wheel-coupling end in a direction away from a surface upon which the patient chair is supported.

In accordance with one more feature of the present invention, the wheelchair-type wheel is coupled to the pivot arm with a quick couple.

In accordance with additional embodiments of the present invention, there is further provided, a patient chair that includes a seat portion and an undercarriage supporting the seat portion, where the undercarriage includes a set of at least three wheels providing mobility to the patient chair, a left wheelchair-type wheel coupling member, a right wheelchair-type wheel coupling member, and a lever operable to move at least one of the left wheelchair-type wheel coupling member and the right wheelchair-type wheel coupling member away from a flooring surface upon which the patient chair is supported.

In accordance with a further feature of the present invention, the lever is a selectively pivotable pivot arm that is activatable by a user's foot.

In accordance with another feature, the lever also includes a wheel-coupling end, a pivot-arm manipulating end, and a pivot point located between the wheel-coupling end and the pivot-arm manipulating end.

In accordance with yet another feature, an embodiment of the present invention includes a bias member biasing the wheel-coupling end of the pivot arm in a downward direction.

In accordance with the present invention, a method of transferring a patient includes providing a mobile patient chair that has a seat portion and an undercarriage supporting the seat portion, where the undercarriage has a set of at least three wheels providing mobility to the patient chair, a left wheelchair-type wheel coupling member, a right wheelchair-type wheel coupling member, and a lever operable to move at least one of the left wheelchair-type wheel coupling member and the right wheelchair-type wheel coupling member away from a flooring surface upon which the patient chair is supported. The method further includes manipulating the lever in a first direction, coupling at least a first wheelchair-type wheel to at least one of the left wheelchair-type wheel coupling member and the right wheelchair-type wheel coupling member of the mobile patient chair, manipulating the lever in a second direction, and manipulating the coupled wheelchair-type wheel to cause the mobile patient chair to move.

In accordance with yet another feature, an embodiment of the present invention includes the step of maneuvering the mobile patient chair to a first position adjacent a target patient delivery location, manipulating the lever in the first direction, decoupling one of the first wheelchair-type wheel and the second wheelchair-type wheel from its respective wheel coupling member, maneuvering the mobile patient chair to a second position adjacent the target patient delivery location, the second position closer to the target patient delivery location than the first position, and transferring a patient from the seat portion to the target patient delivery location.

In accordance with still another feature, the step of transferring the patient includes moving the patient sideways relative to the seat, i.e., over a location of the respective wheel coupling member.

In accordance with still another feature, the method includes pressing down on the lever with a user's foot to manipulate the lever in the first direction.

In accordance with still another feature, a bias member biases the lever in the second direction.

In accordance with additional embodiments of the present invention, a mobile patient chair and method of transferring a patient include providing a mobile patient chair with a seat portion and an undercarriage supporting the seat portion, where the undercarriage includes a set of four wheels providing mobility to the patient chair, a left wheelchair-type wheel coupling member, a right wheelchair-type wheel coupling member, and a pair of levers operable to move the wheelchair-type wheel coupling members away from a flooring surface upon which the patient chair is supported. The method includes manipulating each of the levers in a first direction, coupling wheelchair-type wheels to the wheelchair-type wheel coupling members, manipulating the levers in a second direction, and manipulating the coupled wheelchair-type wheel to cause the mobile patient chair to move.

With the foregoing and other objects in view, there is provided, in accordance with the invention, a mobile patient chair having a seat portion and an undercarriage coupled to and supporting the seat portion, where the undercarriage includes a frame having at least one selectively rolling wheel, a rocking mechanism coupling the seat portion to the frame and operable to move the seat in a substantially forward and backward translating movement relative to the frame, and a lockout ember having a first position that prevents a rolling ability of the at least one selectively roiling wheel and does not prevent the rocking mechanism from the substantially forward and backward translating movement relative to the frame and a second position that does not inhibit the rolling ability of the at least one selectively roiling wheel and does prevent the rocking mechanism from the substantially forward and backward translating movement relative to the frame.

In accordance with a further feature of the present invention, the first position and the second position of the lockout member are selectable by activation of a single lever, which can be a two-position foot pedal.

In accordance with another feature of the present invention, the at least one selectively roiling wheel is a set of four wheels operable to reduce friction between the frame and a flooring surface upon which the mobile patient chair is supported.

In accordance with yet another feature of the present invention, the first position of the lockout member also prevents a steering ability of the at least one selectively rolling wheel.

In accordance with an additional feature of the present invention, the rocking mechanism includes a lockout plate defining an aperture and the lockout member has an engagement member shaped to fit within the aperture when the lockout member is in the second position.

In accordance with yet one more feature, an embodiment of the present invention includes a frame bar coupled to the at least one selectively rolling wheel and to the lockout member, wherein an axial rotation of the frame bar moves the lockout member between the first position and the second position.

In accordance with a further feature, an embodiment of the present invention includes a foot activatable lever coupled to the frame bar and operable to cause the axial rotation of the frame bar in response to receiving a force from a foot.

In accordance with additional embodiments of the present invention, there is further provided, a patient chair that includes a seat portion and an undercarriage coupled to and supporting the seat portion, where the undercarriage includes a frame having a set of rollers and a rocking mechanism coupling the seat portion to the frame. The chair has a rolling mode, whereby the set of rollers rotate and allow the mobile patient chair to move from a first location to a second location and a rocking mode, whereby the rocking mechanism is operable to move the seat in a substantially forward and backward translating movement relative to the frame. A lockout ember renders the rolling mode and the rocking mode mutually exclusive.

In accordance with yet another feature of the present invention, the lockout member has a first position that prevents a rolling ability of the set of rollers and does not prevent the rocking mechanism from the substantially forward and backward translating movement relative to the frame and a second position that does not inhibit the rolling ability of the set of rollers and does prevent the rocking mechanism from the substantially forward and backward translating movement relative to the frame.

In accordance with yet one more feature, an embodiment of the present invention includes a frame bar coupled to at least one of the set of rollers and to the lockout member, wherein an axial rotation of the frame bar moves the lockout member between the first position and the second position.

In accordance with a further feature of the present invention, a foot activatable lever is coupled to the frame bar and operable to cause the axial rotation of the frame bar in response to receiving a force from a foot.

In accordance with additional embodiments of the present invention, there is further provided, a method for selecting between nodes of a mobile patient rocking chair that includes the step of providing a mobile patient rocking chair that includes a seat portion and an undercarriage coupled to and supporting the seat portion, the undercarriage having a frame having a set of rollers and a rocking mechanism coupling the seat portion to the frame. The method also includes the step of selecting between a rolling mode, whereby the set of rollers rotate and allow the mobile patient rocking chair to move from a first location to a second location and a rocking mode, whereby the rocking mechanism is operable to move the seat in a substantially forward and backward translating movement relative to the frame by activation of a single member, whereby the roiling mode and the rocking mode are mutually exclusive.

In accordance with an additional feature of the present invention, the selecting between the rolling mode and the rocking mode is performed by providing a force from a user's foot.

With the foregoing and other objects in view, there is provided, in accordance with the invention, a mobile patient chair includes a seat portion, an undercarriage coupled to and supporting the seat portion, where the undercarriage includes a frame, a rocking mechanism coupling the seat portion to the frame and movable relative to the frame, and a set of wheels coupled to the frame, and the chair further includes a set of exercise handles mechanically coupled to the frame and shaped so that a person seated in the chair can grasp the handles and cause the chair to translate back and forth relative to the frame.

In accordance with a further feature of the present invention, the set of wheels are operable to reduce friction between the frame and a flooring surface upon which the mobile chair is supported.

In accordance with yet another feature of the present invention, the exercise handles are selectively couplable to the frame at a plurality of selectable angles.

In accordance with an additional feature of the present invention, wherein the set of exercise handles further comprise a grasping end, a frame-coupling end opposite the grasping end, and a set of teeth at the frame-coupling end, wherein the plurality of angles are selectable by aligning the set of teeth with features of the frame.

In accordance with a further feature of the present invention, the features of the frame is a set of teeth shaped to correspond with the set of teeth of the exercise handles.

In accordance with another feature, the set of exercise handles is two separate handles.

In accordance with another feature, an embodiment of the present invention includes a set of set keys removably coupling the exercise handles to the frame.

In accordance with additional embodiments of the present invention, there is further provided, a mobile chair that comprises a frame, a set of rolling wheels coupled to the frame, a seat portion mechanically coupled to the frame and movable in a back and forth motion, relative to the frame, and at least one exercise handle mechanically coupled to the frame and providing an occupant of the seat a means for moving the seat in the back and forth motion relative to the frame and the wheels.

In accordance with still another feature, method for exercising in a chair includes providing a mobile chair that includes a seat portion, an undercarriage coupled to and supporting the seat portion, where the undercarriage includes a frame, a rocking mechanism coupling the seat portion to the frame and movable relative to the frame, and a set of rolling wheels coupled to the frame, and at least one exercise handle mechanically coupled to the frame and shaped to extend above a lower portion of the seat portion. The method further includes sitting in the seat portion and applying a sufficient force to the at least one handle to cause the seat portion to move in a substantially lateral direction relative to the frame.

In accordance with a further feature of the present invention, the method also includes coupling a coupling portion of the at least one exercise handle to the frame in a first position, at least partially decoupling the coupling portion of the at least one exercise handle from the frame, rotating the at least one exercise handle relative to the frame, coupling the coupling portion of the at least one exercise handle to the frame in a second position different from the first position, and securing the coupling portion to the frame in the second position by manipulating a securing member, e.g., a set key.

In accordance with another feature of the present invention, the method includes securing the coupling portion to the frame in the first position by manipulating a set key.

In accordance with other embodiments of the present invention, there is further provided, a mobile chair and method for exercising in the chair include a mobile chair that includes a seat portion, an undercarriage coupled to and supporting the seat portion, the undercarriage including a frame, a rocking mechanism coupling the seat portion to the frame and movable relative to the frame, and a set of rolling wheels coupled to the frame, and at least one exercise handle mechanically coupled to the frame and shaped to extend above a lower portion of the seat portion. The method includes sitting in the seat portion and applying a sufficient force to the at least one handle to cause the seat portion to move in a substantially lateral direction relative to the frame.

Although the invention is illustrated and described herein as embodied in a mobile rocking patient chair, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
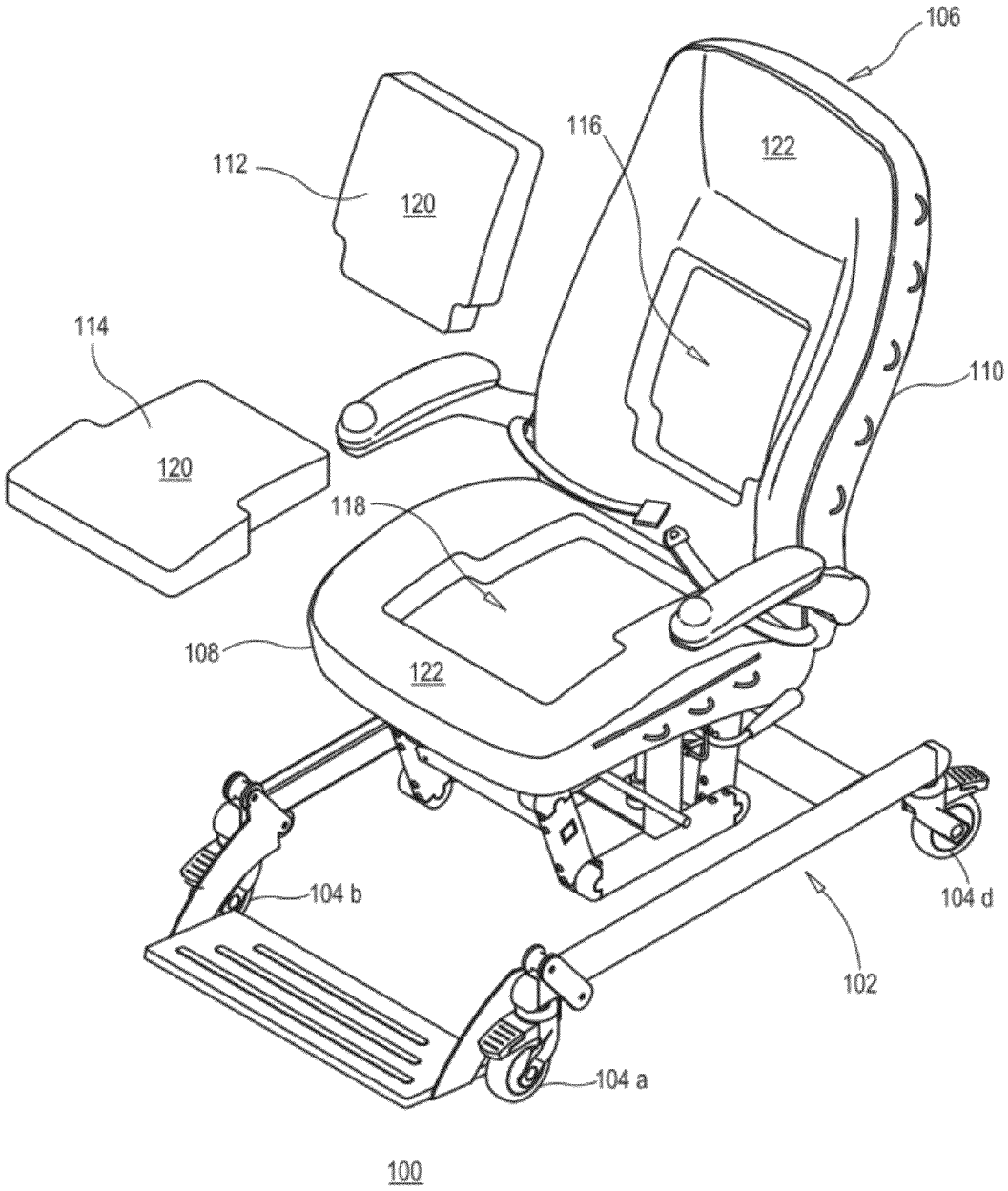
FIG. 1 is a left-side perspective view of a mobile patient rocking chair assembly showing removable cushion inserts in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel mobile patient chair that allows the seated person to rock back and forth. Embodiments of the invention provide the ability to quickly and easily transfer the seated person from the novel chair to an adjacent surface. In addition, embodiments of the invention provide various rocking features that result in exercise for the seated person during the rocking motion. Further, embodiments of the invention provide removable cushion inserts that provide comfort and ease of cleaning while maintaining durability of the surrounding seat surfaces.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components.

The first example of a mobile patient rocking chair assembly 100, as shown in FIG. 1, includes an undercarriage 102 that supports a chair 106 on top and features a set of wheels 104*a-d* below that provide mobility to the undercarriage 102. The chair 106 is used to support a person when placed in the inventive patient rocking chair assembly 100. Although four wheels are shown, the invention is not no limited and can utilize any number of wheels, rollers, casters, and other elements to provide mobility.

The chair 106 also includes a seat portion 108 and a back portion 110. The seat portion 108 supports the lower portion of a person's body and the back portion 110 supports the upper portion of a person's body. As is shown in FIG. 1, the chair 106 is formed, although not necessarily, in an ergonomic shape that conforms to the contours of a user's body when the user is sitting in the chair 106. The chair however, is not required to have such a shape and any chair that supports a person's body is within the spirit and scope of the present invention.

Removable Inserts

It is envisioned that the mobile patient rocking chair assembly 100 will be used, at times, by those suffering from issues of incontinence. When an episode of incontinence occurs, the chair in which the user is seated can come into contact with the moisture. For this reason, easy cleaning of the chair 106 is desired. To facilitate easy cleaning, many prior-art patient chairs wrapped foam or some other pillow-type material with an easy-to-clean material, such as leather, Naugahyde, vinyl or other similar materials. However, these materials do not "breathe," i.e., allow air to circulate, and quickly become hot and uncomfortable to sit on. On the other hand, cloth materials, which provide improved air circulation, allow moisture to soak in and are not desirable for chairs used by people suffering from incontinence.

In accordance with the present invention, the inventive mobile patient rocking chair assembly 100 provides a chair 106 with removable inserts 112 and 114. Each insert 112 and 114 fits within a corresponding cavity 116 and 118, respectively, formed in the chair 106. More specifically, the removable insert 112 fits within the cavity 116 formed in the back portion 110 of the chair 106. Similarly, the removable insert 114 fits within the cavity 118 of the seat portion 108 of the chair 106.

Although any material can be used, in accordance with a preferred embodiment of the present invention, each removable insert 112 and 114 features a cushion on its interior surrounded by a "breathable" material 120, such as cloth. It is envisioned, that the cushion surrounded by the breathable material 120 is surrounded by a waterproof non-permeable protective covering that prevents moisture from contacting the cushion material. The waterproof protective covering can be, for example, plastic, vinyl, leather, Naugahyde, or other similar materials.

In accordance with embodiments of the present invention, the back portion 110 of the chair 106 and the seat portion 108 of the chair 106 can be covered in a waterproof material 122, such as vinyl, leather, Naugahyde, plastic, and other similar materials that do not allow moisture to penetrate to the interior of the back portion 110 or the seat portion 108.

Upon the detection of an incontinence episode or any other occurrence of moisture contacting the chair 106, the novel chair can be quickly and effectively cleaned. In a first step, the removable inserts 112 and 114 are removed from their respective cavities 116 and 118. The breathable material 120 is then removed from its supporting cushion. The removal can be through use of a zipper, VELCRO, elastic material, or other materials that allow the breathable covering material 120 to be removed from its cushion.

Next, the cushions, which are, as described above, covered in a waterproof material, are wiped down with a disinfecting solution. Similarly, the back portion 110 and the seat portion 108, which are both also covered with a waterproof material, are wiped down with a disinfecting solution. This includes the cavity portions 116 and 118. Because both of the removable inserts 112 and 114 and the back portion 110 and the seat portion 108 are waterproof, no moisture penetrates to the interior of either. It should be noted that the shape and size of the removable inserts 112 and 114 and corresponding cavity portions 116 and 118 are merely exemplary and the present invention is not so limited. In one embodiment, the lower insert 112 extends to and up the back portion 110 of the chair 106 and features an "L" bend that captures liquid. In another embodiment the upper insert 112 extends to the bottom of the back portion 110.

The removable breathable coverings 120 of the removable inserts 112 and 114 can easily be washed and replaced back onto their respective cushions once clean. In addition, any patterns or colors used on the coverings 120 can be easily updated without having to re-upholster the entire chair. Furthermore, the cushions within the breathable coverings 120 can be selectively replaced with cushions of varying densities. For example, a cushion having an increased density can be used for a heavier patient, where a cushion of a lower density can be used for a lighter patient. In this way, the chair can be configured specifically to the desires of the patient.

The inventive chair 100 can also be provided with optional pads that slip onto the seat portion 108, back portion 110, or the armrests to provided improved comfort for the user.

Advantageously, the inventive chair 106 of the mobile patient rocking chair assembly 100 provides an ergonomic comfortable seat that conforms to the patient's body as well as a seat and back portion that does not trap heat and moisture as do prior-art patient seats but can also be cleaned quickly, easily, effectively, and inexpensively.

Exercise Handles

Figure 2:
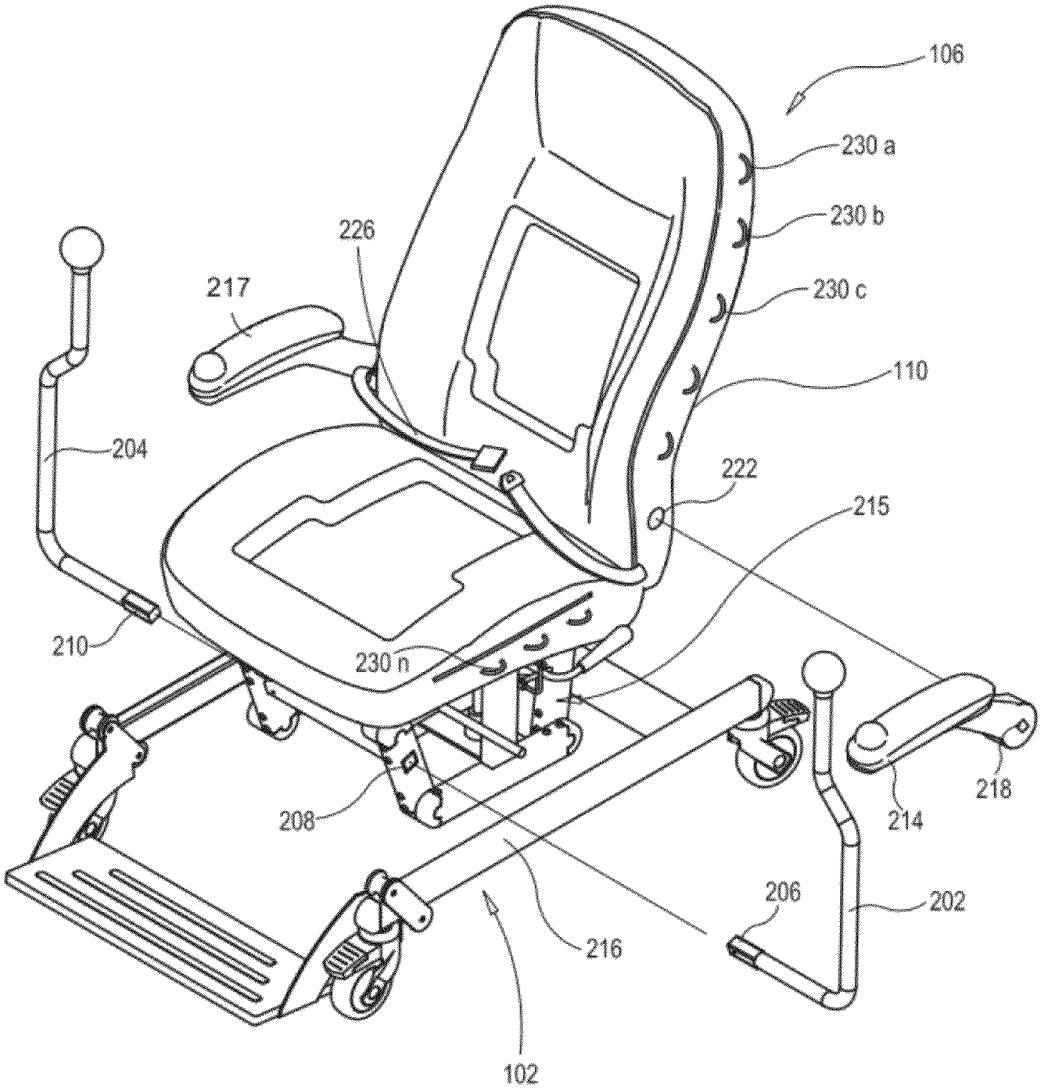
FIG. 2 is a left-side perspective view of the mobile patient rocking chair assembly of FIG. 1 showing removable exercise handles and armrests in accordance with the present invention.

Referring now to FIG. 2, the front-side downward-looking perspective view of the mobile patient rocking chair assembly 100 shows a left 202 and a right 204 exercise handle that can be removably attached to the undercarriage 102. The left exercise handle 202 features a coupling portion 206 that selectively removably couples to a receiver 208 in the left side of the undercarriage 102. Similarly, the right exercise handle 204 features a coupling portion 210 that selectively removably couples to a receiver 212 in the right side of the undercarriage 102, although the right-side receiver 212 cannot be seen in the left-side perspective view of FIG. 2.

The undercarriage 102 provides therein a rocking mechanism 215 that allows the chair 106 to move back and forth with respect to a frame 216. The rocking mechanism 215 will be described in detail below however, for the instant discussion, it is to be understood that the rocking mechanism 215 provides a rocking motion similar to that found in many prior-art nursing chairs utilized by new mothers to rock their babies.

As with prior-art rocking chairs, the rocking motion can be caused by movement of the user's upper body or by a force applied by the user's feet, which causes the upper portion of the chair to move relative to the frame 216. Advantageously, the left 202 and right 204 exercise handles of the present invention provide a further structure for allowing a user to obtain exercise. That is, in addition to the standard methods of pushing with their feet or rocking their upper body, a user can now utilize a pushing or pulling on with their arms to cause the chair 106 to rock with relation to the frame 216. Pushing and/or pulling on the exercise handles 202, 204 involves the user's chest muscles, back muscles, triceps, biceps, and other muscles that are not involved in traditional rocking motion.

Advantageously, because the exercise handles 202, 204 are removably coupled to the undercarriage 102, they can be selectively removed and stored when not needed, which allows improved mobility and an improved ability for the user to enter and exit the chair 106. In accordance with an embodiment of the present invention, the exercise handles 202, 204 can be reconfigured to provide a push handle so that a technician can push the mobile patient rocking chair assembly 100, for example, down a hallway. Several alternative embodiments allow the exercise handles 202, 204 to be utilized as pushing handles. In accordance with a first embodiment, the back portion 110 of the chair 106 is provided with a left 214 and a right 217 armrest. Each armrest 214, 217 is provided with a receiver 218, 220, respectively. Each receiver 218, 220 is substantially similar to the receivers 208, 212 formed and the undercarriage 102. In this embodiment, the exercise handles 202, 204 are simply relocated from their respective receivers 208, 212 in the undercarriage 102 to the receivers 218, 220 in the armrest portions 214, 217, respectively. Advantageously, the exercise handles 202 and 204, when in the secondary receivers 218, 220, are not only conveniently stored and out of the way of the person seated in the chair 106, but can now be used by a person pushing the chair.

Alternatively, the armrests 214, 217 can be removed from the back portion 110 and the exercise handles 202, 204 can be inserted into exposed receivers 222, 224 of which the armrests 214, 217 were previously inserted. In this mode, because the armrests 214, 217 are no longer present, a seat belt 226 can be utilized to ensure that the patient does not become separated from the chair 106.

It should be noted that the primary left receiver 208 and its non-illustrated counterpart, right receiver 212, can be provided in locations other than that shown in FIG. 2. Other suitable locations will be apparent from the below description of further mechanical elements of the rocking mechanism 215.

Figure 15:
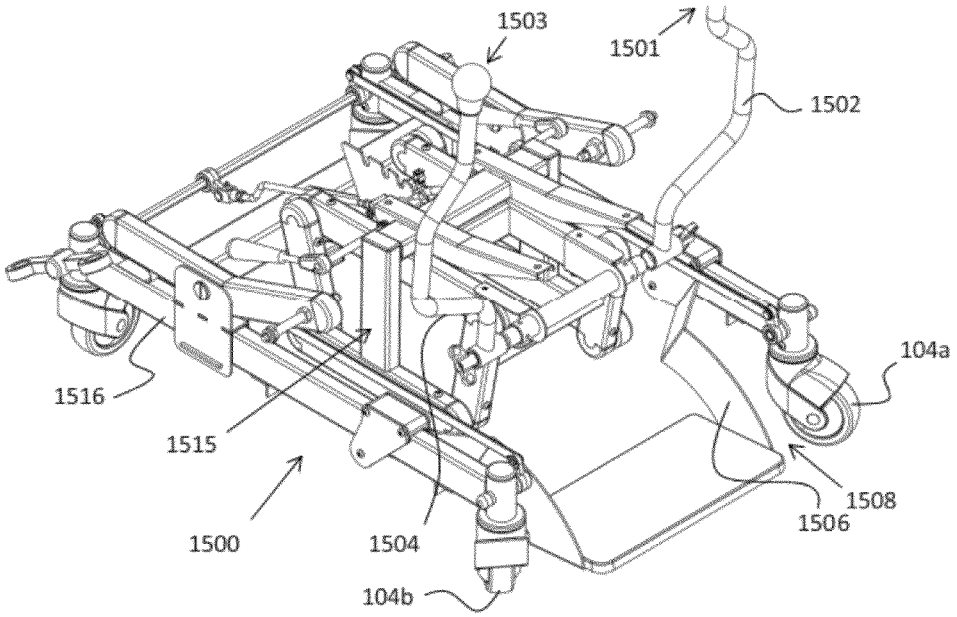
FIG. 15 is a perspective downward-looking front view of an undercarriage having a frame and rocking mechanism with the chair removed and exercise handles partially installed in accordance with the present invention.
Figure 16:
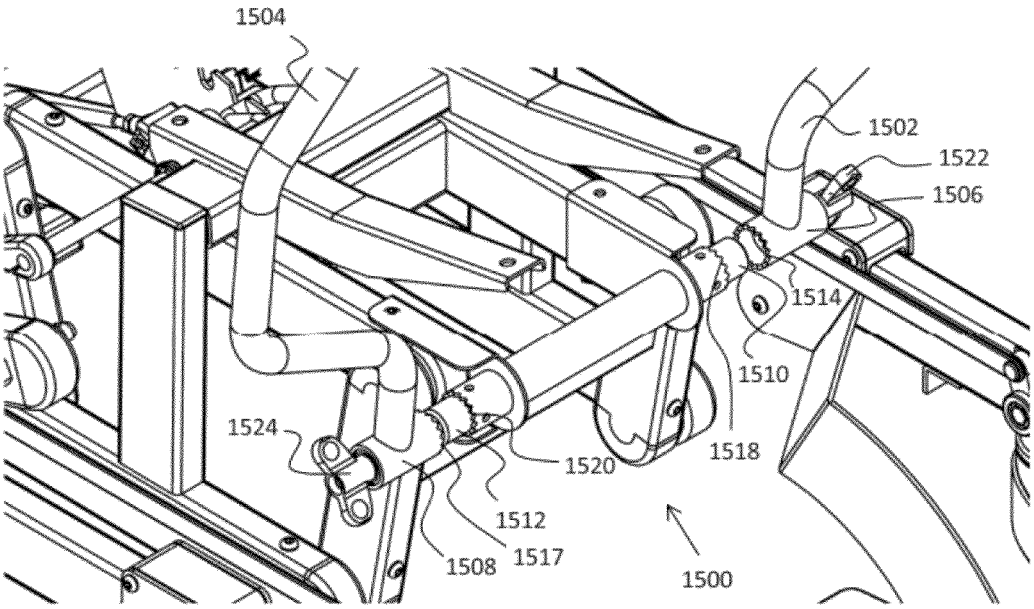
FIG. 16 is a close-up partial perspective downward-looking front view of the partially-installed exercise handles of FIG. 15.

FIGS. 15 and 16 provide an illustration of an alternate coupling between the exercise handles 1502 and 1504 and an undercarriage 1500. The close-up view of FIG. 16 shows that each of the handles 1502 and 1504 have lower coupling portions 1506 and 1508, respectively, that slidably engage with extensions 1510 and 1512, respectively, of the undercarriage 1500. The extensions 1510 and 1512 are mechanically and fixedly attached to the undercarriage 1500 and provide structural support for attaching the handles 1502 and 1504 to the undercarriage 1500.

In accordance with the embodiment shown in FIGS. 15 and 16, each of the coupling portions 1506 and 1508 is provided with a set of teeth 1514 and 1517, respectively. Likewise, each of the extensions 1510 and 1512 of the undercarriage 1500 are provided with a corresponding set of teeth 1518 and 1520. The teeth allow the handles 1502 and 1504 to be coupled to the undercarriage 1500 in one of a plurality of selectable angles, or rotational positions, around an axis of the extensions 1510 and 1512. Each of the coupling portions 1506 and 1508 is provided with a set key 1522 and 1524, respectively. Each set key 1522 and 1524 engages with one of the extensions 1510 and 1512 and independently selectively fixes a rotational position of its respective handle 1502 and 1504 about the axis of its respective extensions 1510 and 1512. In one embodiment, the set keys 1522 and 1524 include threaded members that are received within a threaded interior of a corresponding one of the extensions 1510 and 1512. By selectively fixing the handles 1502 and 1504 to the undercarriage 1500, the handles 1502 and 1504 and undercarriage 1500 allow the user to cause the chair (not illustrated in FIG. 15) to move in a substantially lateral direction, i.e., back and forth, with respect to a frame 1516, by applying sufficient force to the grasping ends 1501 and 1503 of the handles 1502 and 1504, respectively, while sitting upon the chair. By selecting from among many available angles for attaching the handles 1502 and 1504 to the undercarriage 1500, the user can select the most comfortable position of the handles 1502 and 1504 and/or the position that targets a particular muscle (s) while performing the pushing/pulling exercises made available by the handles 1502 and 1504.

Exercise Bands

Referring now back to FIG. 2, in a further embodiment of the present invention, the mobile patient rocking chair assembly 100 includes a set of exercise connector points 230*a-n* (where "a-n" represents any range of numbers) along the back portion 110 and, in some embodiments, along the seat portion 108 of the chair 106. The exercise connector points 230*a-n* shown in this view are simply half loops that provide points of attachment for connectors. The loops can be solid or flexible.

Figure 3:
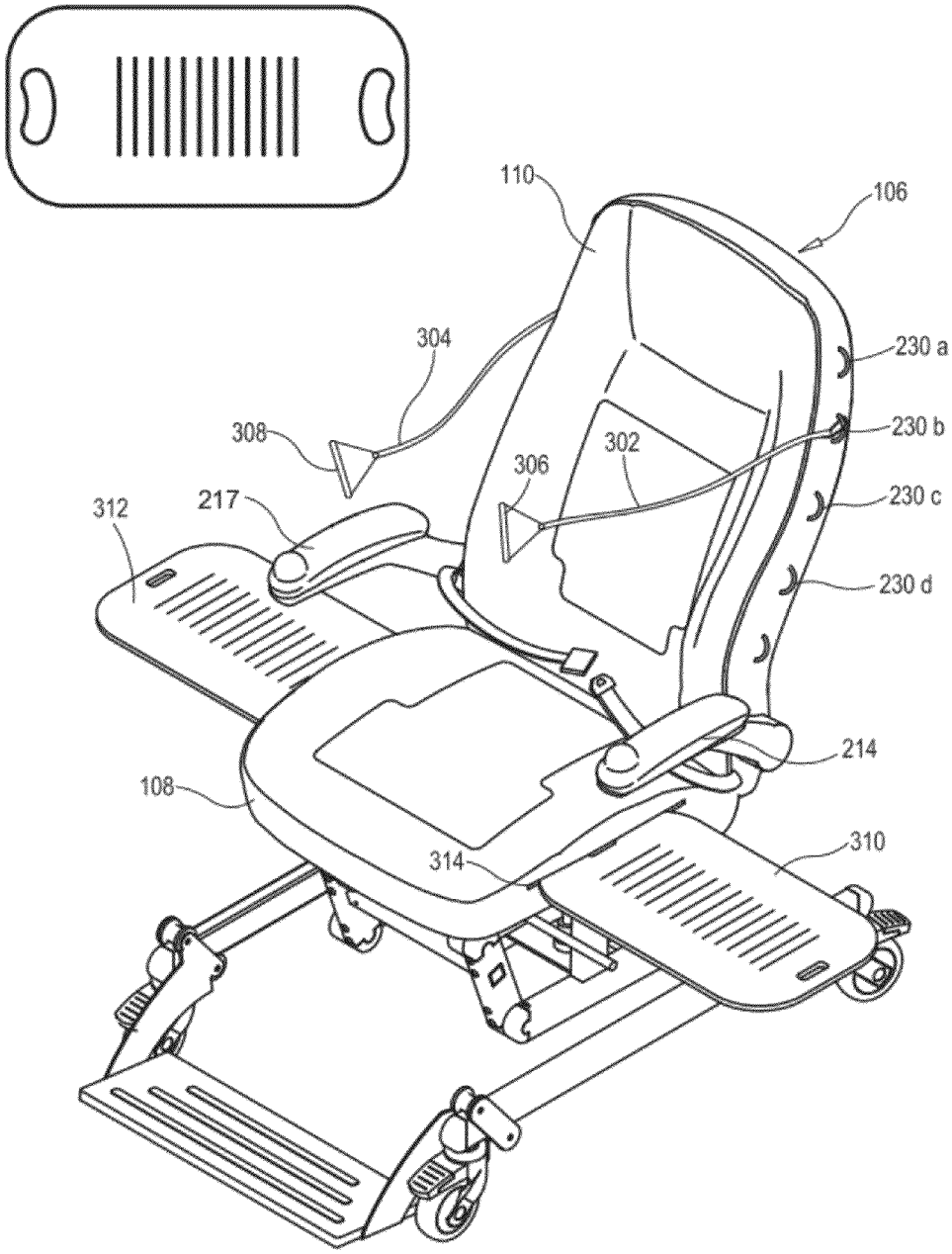
FIG. 3 is a left-side perspective view of the mobile patient rocking chair assembly of FIG. 1 showing concealable patient transfer mats and exercise handles in accordance with the present invention.

Referring now to FIG. 3, a pair of elastic exercise resistance bands 302 and 304 are showing coupled to respective ones of the exercise connector points 230*a-n* on the back portion 110 of the chair 106. The resistance bands 302, 304 can be, for example, plastic, rubber, or other stretchable materials. The exercise resistance bands 302 and 304 are provided with exercise handles 306 and 308, respectively. The exercise handles 306 and 308 are gripped by a patient seated in the mobile patient rocking chair assembly 100 and used to cause the resistance bands 302 and 304 to stretch against the resistance forces provided by the elastic properties of the resistance bands 302 and 304. Overcoming the resistance forces causes the user's muscles to exert force, provides muscle stimulation for the user, resulting in muscle conditioning, increased heart rate, and improve health. The specific muscles targeted by the particular exercise can be selected based on which of the exercise connector points 230*a-n* the resistance bands 302 and 304 are coupled to. For example, the patient can perform exercise motions that target their chest area when the resistance bands 302 and 304 are coupled to exercise connector points 230 on the upper area of the back portion 110 of the chair 106. The patient can perform exercise motions that target their arms, e.g., biceps, when the resistance bands 302 and 304 are coupled to exercise connector points 230 of the seat portion 108 of the chair 106. When the exercise resistance bands 302 and 304 are coupled to the exercise connector points 230 on the lower area of the back portion 110, multiple muscles are involved in the exercise, such as shoulders, biceps, and chest.

Figure 4:
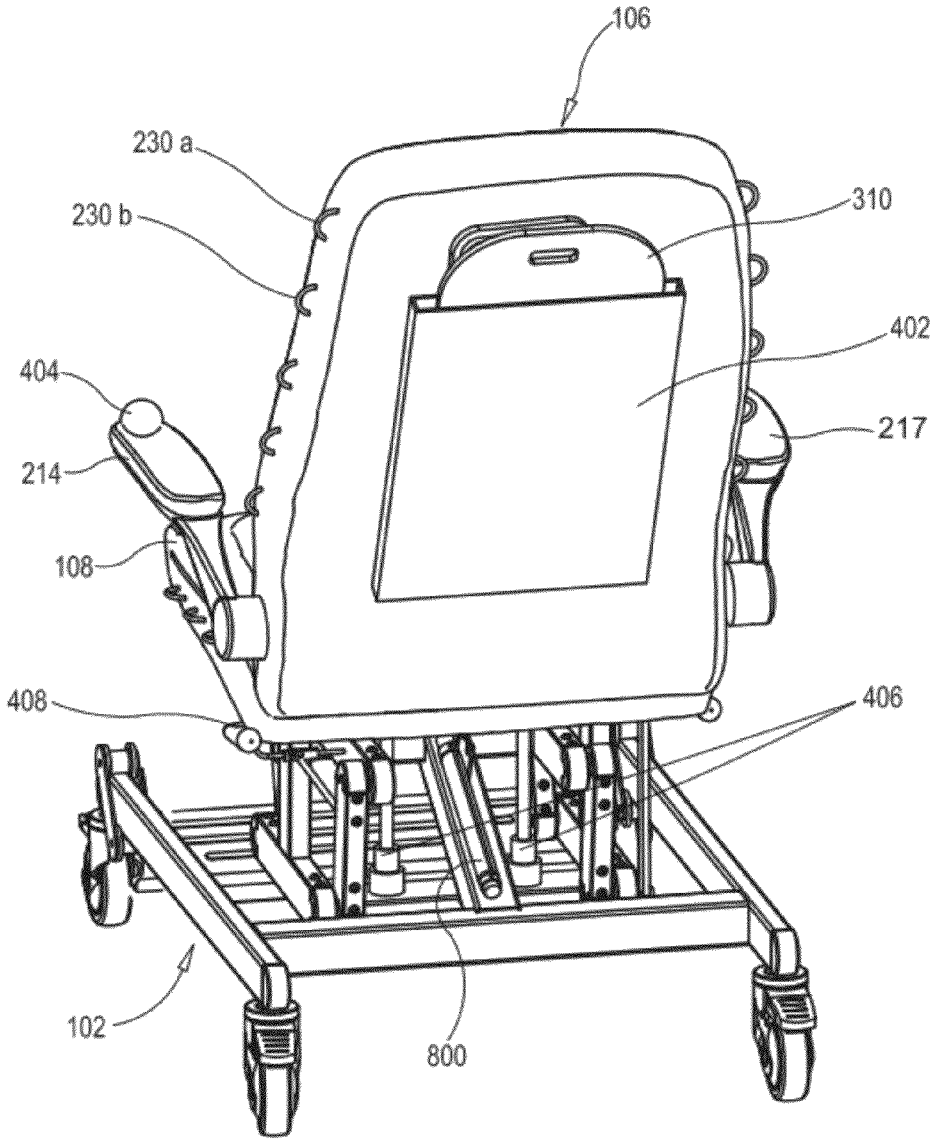
FIG. 4 is a rear-facing perspective view of the mobile patient rocking chair assembly of FIG. 1 showing a storage container holding the patient transfer mats in accordance with the present invention.

The resistance bands 302 and 304 can be quickly and easily detached from the exercise connector points 230 and stored, for example, in a storage bin 402 shown in FIG. 4.

Transfer Mat

Referring still to FIG. 3, the mobile patient rocking chair assembly 100 is shown provided with a pair of transfer mats 310 and 312. More specifically, the seat portion 108 of the chair 106 features a first pocket 314 that receives and conceals the first transfer mat 310 and a second pocket 316 (not visible in the left-side perspective view of FIG. 3) that receives and conceals the second transfer mat 312. Each transfer mat 310, 312 is operable to extend from and be inserted within its respective pocket 314, 316. Once removed from its pocket, the transfer mat is placed as far as is reasonable possible between the seat and the patient's buttocks. Transfer mats and methods of using transfer mats are described in U.S. Pat. No. 4,700,416, issued to the inventor of the present invention. In accordance with all embodiment of the present invention, an upper surface of the transfer mat 310, 312 is provided with a low-resistance material that allows easy transfer of the patient across the transfer mat 310, 312.

An exemplary method of using the transfer mats 310, 312 would be as follows. A patient seated in the mobile patient rocking chair assembly 100 is wheeled to a position adjacent a receiving surface. For example, the patient may be wheeled next to a toilet. Next, the appropriate armrest 214, 217 would be pivoted upward or simply removed from the chair 106. The appropriate transfer mats 310, 312 (left or right) would then be removed from the pocket 314, 316. The proximal end of the transfer mat is placed between the patient's buttocks and the distal extended end of the transfer mat 310, 312 would reach and rest upon the destination surface. At this point, a bridge is provided from the seat portion 108 of the chair 106 to the destination seating location.

In accordance with an alternate embodiment of the present invention, once extended, as shown in FIG. 3, each transfer mat 310, 312 remains secured to the seat portion 108 at its proximal end. The opposing distal end of each transfer mat 310, 312, when the transfer mats are being utilized, is placed on a receiving surface. Generally, only one transfer mat 310, 312 will be used at any given time. Once extended, the transfer mat 310, 312 advantageously provides a bridge for sliding the patient from the seat portion 108 to the destination location, e.g., a patient bed, a toilet, a dining chair, etc.

In accordance with an embodiment of the present invention, the lower surface of the transfer mats 310, 312 are provided with a shape or material that provides resistance and prevents the transfer mat 310, 312 from moving away from the surface upon which it rests. The resistance shape can include notches in the lower portion of the board that receives portions of the destination surface. In other words, the notches grasp onto portions of the surface and prevent separation of the mat from the surface.

In an alternative embodiment, the seat portion 108 of the chair 106 is not provided with pockets for receiving and storing the transfer mats 310, 312. In this embodiment, as shown in FIG. 4, the back portion 110 of the chair 106 is provided with a storage bin 402. Here, only one transfer mat 310 is needed. A single transfer mat 310, when necessary, is removed from the storage bin 402 and used to transfer the patient from whichever side of the seat portion 108 is appropriate. Here, the proximal end of the transfer mat 310 is simply placed on an edge of the seat portion 108 and the distal end of the transfer mat is placed on a surface of the destination location, thereby creating a bridge from the seat portion 108 to the destination location. Again, in this embodiment, the upper surface of the transfer mat 310 provides as little physical resistance as possible and the lower portion of the transfer mat 310 provides resistance that secures the transfer mat 310 and prevents it from slipping during the transfer process.

Adjustable Height

Looking to the rear-facing perspective view of FIG. 4, a further alternative feature of the present invention is shown. In this view, a pair of height-adjustment members 406 can be partially seen positioned under the chair 106. The height-adjustment members 406 have a lower portion fixedly coupled to the undercarriage 102 and are attached at an upper portion to the chair 106. When operated, the height-adjustment members 406 can selectively raise or lower the chair 106. The height-adjustment members 406 can be ratcheting devices, gas springs, hydraulic mechanisms, electric motors, or any other apparatus for raising and lowering the height of the chair 106.

The height-adjustment members 406 are particularly useful for matching the height of the seat portion 108 to an adjacent surface onto which the patient is to be transferred. If the height between the seat portion 108 matches the surface onto which the patient is to be transferred, the transfer mat 310, 312 can be easily extended from within its respective pocket 314, 316 and easily rests on the adjacent surface.

In a first embodiment of the present invention, the patient seated within the chair 106 is able to manipulate the height-adjustment members 406 to cause the chair to raise or lower. This can be done by providing a handle, for example, handle 408 shown in FIG. 4, that the patient can easily reach in manipulate. In other embodiments, the control for the height adjustment members 406 is accessible only to a technician assisting the patient.

Arm Rest

As the rear-facing perspective view of FIG. 4 illustrates, the armrests 214, 217 can be provided with a tactile feature 404. The exemplary tactile feature 404 illustrated in FIG. 4 is a curved ball-like shape. It has been scientifically proven that people, in particular, elderly persons, benefit from regular use of their tactile senses. By providing the alternative tactile feature 404 on the armrest 214, 217 a patient seated within the chair 106 has the tactile feature 404 at their fingertips at all times. Touching and allowing their fingers to explore the shape of the tactile feature 404 provides constant stimulation for the patient, thereby producing a positive therapeutic result both physically and mentally.

Embodiments of the present invention allow the tactile feature 404 shown in FIG. 4 to be exchanged with alternate tactile features having shapes that vary from that shown in FIG. 4. The alternate tactile features can simply snap into place once the tactile feature 404 is removed.

Rocking Mechanism

Figure 5:
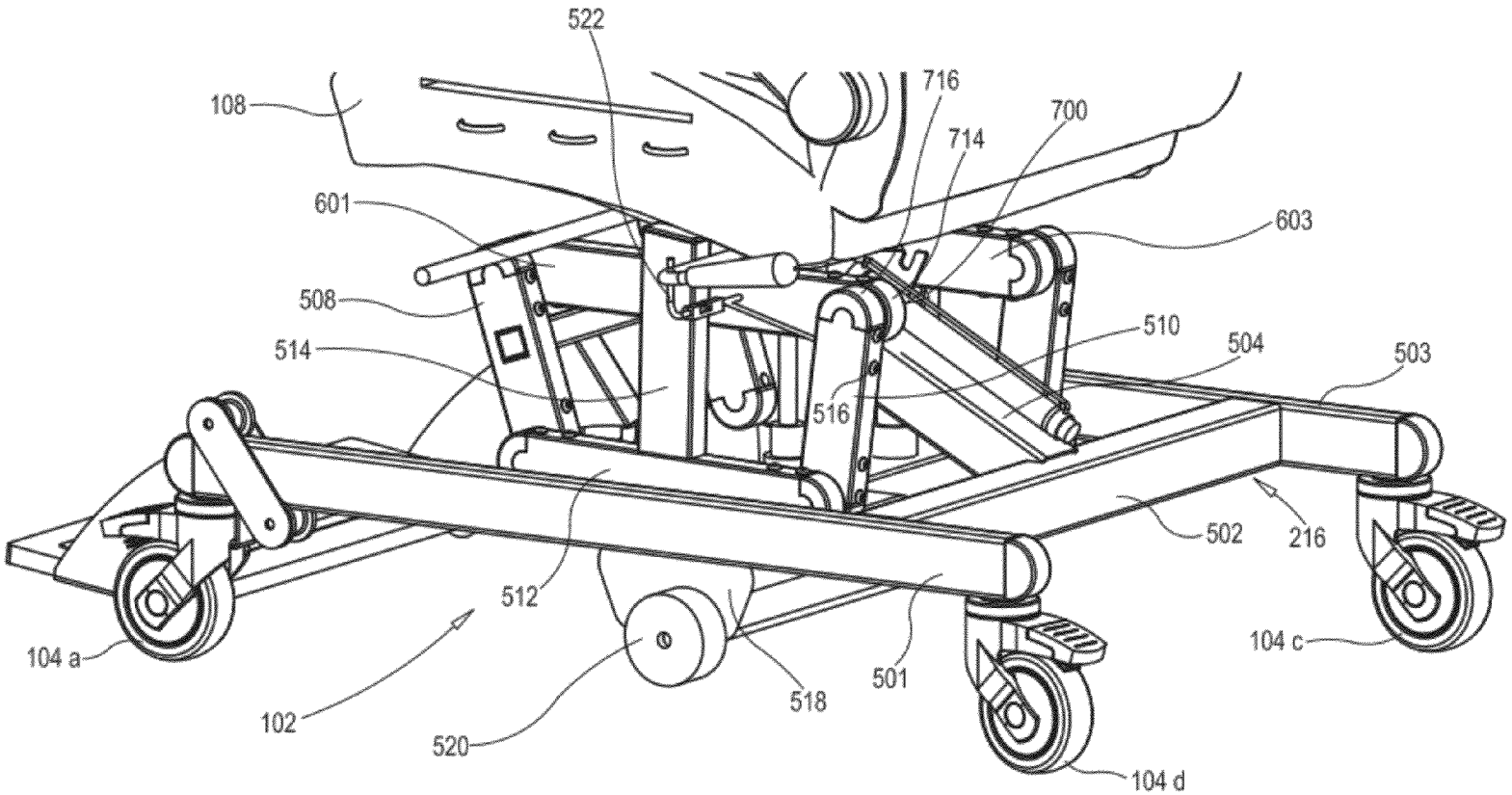
FIG. 5 is a fragmentary, side perspective view of the undercarriage of the mobile patient rocking chair assembly of FIG. 1.

Referring now to FIG. 5, the undercarriage 102 is shown in a perspective left-hand partial rear view. The undercarriage 102 has a frame 216 that includes a lower center support member 502 that couples to a lower left runner 501 on the left side thereof and a lower right runner 503 on the right side thereof. The lower center support member 502, the lower left runner 501, and the lower right runner 503 provide the main structure upon which the other undercarriage components are supported. This main frame structure is spaced from the flooring surface upon which the chair is supported and receives mobility from the plurality of wheels 104*a-d*. More specifically, left-side wheels 104*a*, 104*d* are attached to the lower left runner 501 and the right-side wheels 104*b*, 104*c* are attached to the lower right runner 501. The wheels shown are caster-type wheels, but do not necessarily have to be casters.

Extending from a central location along the lower center support member 502 is a crossbar 504 that extends in a diagonal upward direction. Attached to the crossbar 504 at a height above the lower center support member 502 is an upper center support member 602, which is best shown in the front left-hand side perspective view of the undercarriage 102 in FIG. 6. The upper center support member 602 couples to an upper left runner 601 on the left side thereof and an upper right runner 603 on the right side thereof. The left and right upper runners 601 and 603 are substantially parallel to the left and right lower runners 501 and 503. Each of the connections between the lower center support member 502, the lower left runner 501, the lower right runner 503, and the crossbar 504 is fixed, e.g., welded. Similarly, each of the connections between the crossbar 504, the upper left runner 601, and the upper right runner 603 is fixed, e.g., welded.

Returning once again to left-side view of FIG. 5, it can be seen that a left front swing bar 508 and a left rear swing bar 510 are attached to the left upper runner 601. In accordance with the present invention, each of the left swing bars 508, 510 are rotationally coupled to the left upper runner 601 at their upper ends. This rotational coupling allows the left swing bars 508, 510 to rotate with respect to the fixed left upper runner 601. A coupling linkage 700 allows the left swing bars 508, 510 to rotate with respect to the left upper runner 601. The coupling linkage 700 is shown in detail in FIG. 7 and fully described below in the section entitled "Coupling Linkage."

At their lower ends, each of the left swing bars 508, 510 are rotationally coupled to a left swing bar connector 512, which places the left swing bars 508, 510 in mechanical communication with each other at their lower ends. Because the left swing bars are rotationally coupled to the left swing bar connector 512, when the left swing bars 508, 510 swing relative to the fixed left upper runner 601, the left swing bar connector 512 also moves relative to the left upper runner 601.

A left vertical support member 514 is coupled to the left swing bar connector 512 and extends upwardly and substantially perpendicularly therefrom. Referring once again to FIG. 6, the downwardly-looking perspective view of the undercarriage 102 with the chair portion 106 removed shows that a chair coupling platform 604 is provided at an upper portion of the vertical support member 514. The chair coupling platform 604 provides a location for the chair 106 to be attached.

Figure 6:
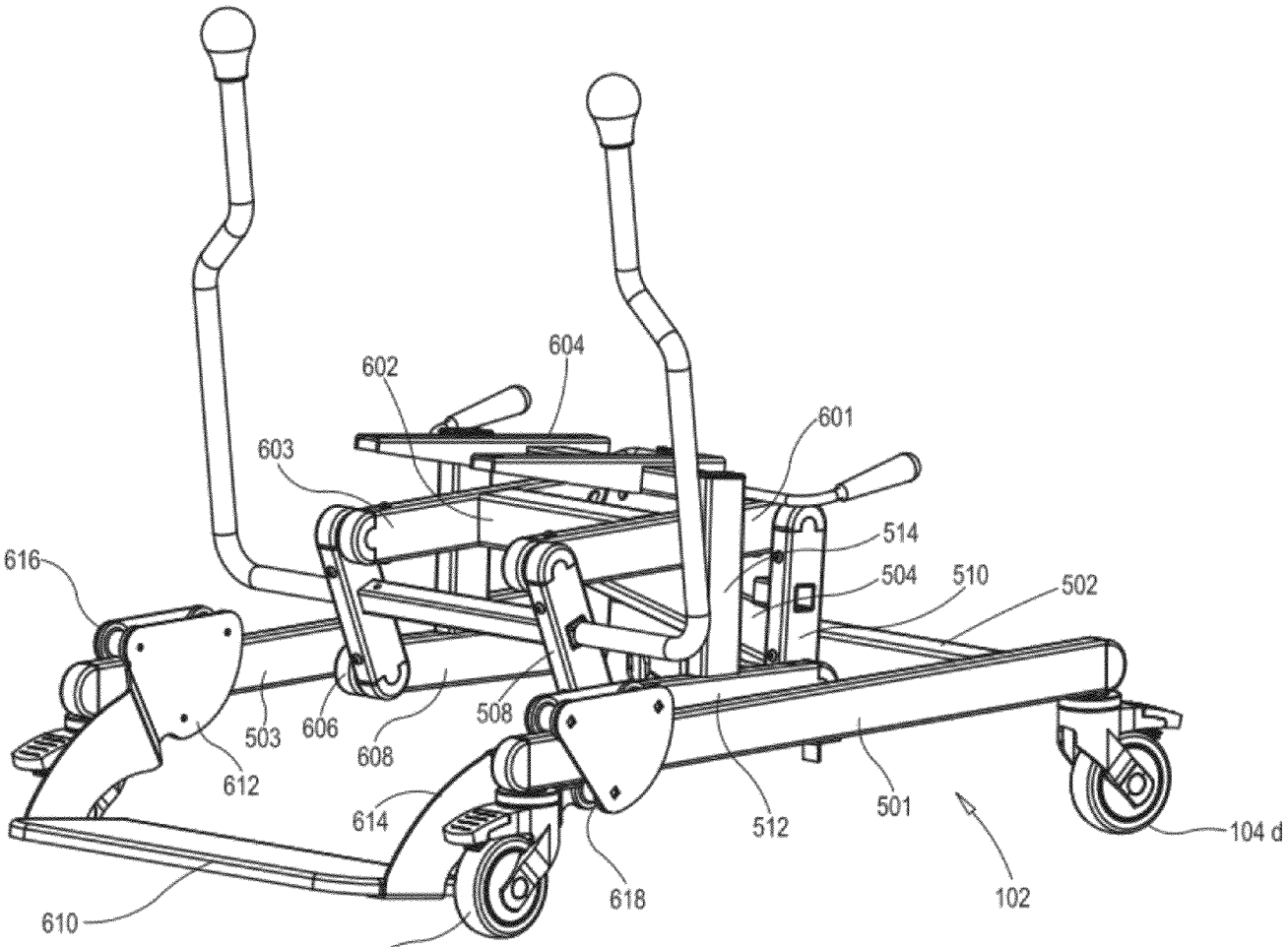
FIG. 6 is a left front perspective view of the undercarriage of the mobile patient rocking chair assembly of FIG. 1.

FIG. 6 also shows that the left front swing bar 508 has a right counterpart 606 on the right side of the frame. Likewise, the left swing bar connector 512 has a right counterpart 608 on the right side of the frame, which is itself coupled to a right vertical support member 614 that mirrors the left vertical support member 514. Although it cannot be seen in the perspective left-side view of FIG. 6, the left rear swing bar 510 also has a right counterpart 607. In essence, the undercarriage 102 provides two separate four-bar linkage assemblies, with elements 601, 508, 512, and 510 defining the left four-bar linkage assembly. Likewise, elements 603, 606, 607, and 608 define the right four-bar linkage assembly.

During a swinging motion, once the chair 106 is mechanically coupled to the chair coupling platform 604, the chair 106 will move in unison with the swing bar connectors 512, 608. The mechanical movement of the rotating swing bars 508, 510, 606, 607 gently moves the swing bar connectors 512, 608 forwards and backwards delivering a gentle rocking motion to the attached chair 106.

Coupling Linkage

Figure 7:
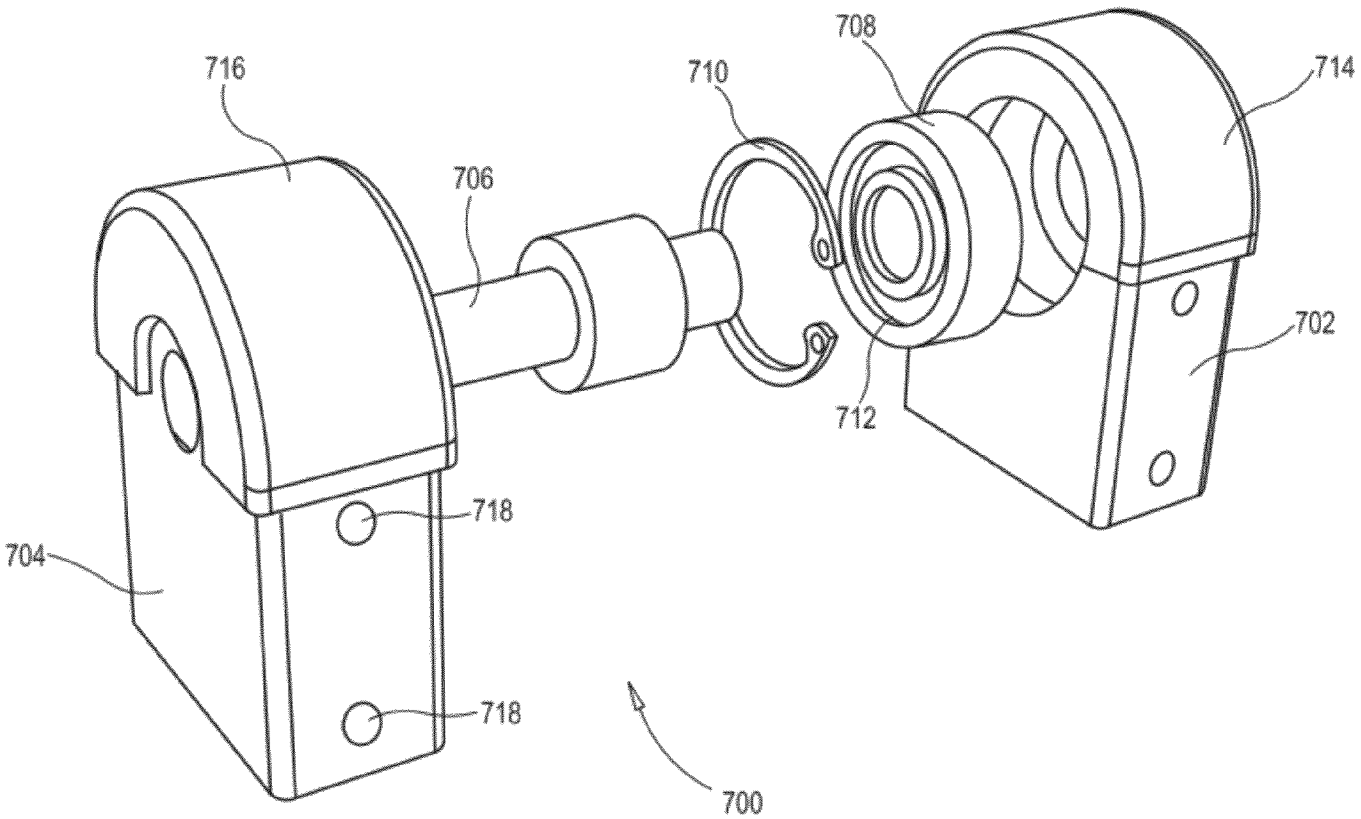
FIG. 7 is an exploded perspective view of a coupling connector in accordance with the present invention.

FIG. 7 provides an exploded perspective view of a coupling linkage 700 that is used in accordance with an embodiment of the present invention to provide the rotational coupling between elements of the left and right four-bar linkage assemblies shown in FIGS. 5 and 6.

The coupling linkage 700 includes a first sleeve insert 702 and a second sleeve insert 704. A shaft 706 is fixedly coupled to one of the sleeve inserts, in this embodiment, the second sleeve insert 704. A bearing 708 is coupled to the opposing sleeve insert 702 by a cap 714. A circlip 710 is used to secure one end of the shaft 706 within the bearing 708. The circlip 710 is a semi-flexible metal ring fastener with open ends which can be snapped into place, into a machined groove 712 on an interior edge of the bearing 708, to permit rotation but to prevent lateral movement of the shaft 706. Because the shaft 706 is fixedly attached to the second sleeve insert 704, the circlip 710 ensures that during rotation, the first 702 and second 704 sleeve inserts remain a fixed lateral distance from each other.

In the embodiment shown in FIG. 7, the right sleeve insert 702 is provided with a right cap 714 and the left sleeve insert 704 is provided with a left cap 716. Each cap 714, 716 has a dimension that is slightly larger than that of the sleep insert upon which it is connected. The larger dimension of the caps 714, 716 allows the sleeve inserts 713, 714, respectively to only travel a certain distance into the sleeves in which they are installed. The larger dimension of the caps 714, 716 will hit the sleeves and prevent further entry of the sleeve inserts.

Referring again back to FIG. 5, and focusing on the left rear swing bar 510 and the left upper runner 601, the coupling linkage 700 is shown coupling the two members 510, 601 together. In particular, the first cap 714 can be seen extending from the left upper runner 601 and the second cap 716 can be seen extending from the left rear swing bar 510. Within the left upper runner 601 is the first sleeve insert 702. Likewise, within the left rear swing bar 510 is the second sleeve insert 704. A pair of bolts 516 penetrate through the left rear swing bar 510 and into a set of threaded voids 718 shown in FIG. 7. The bolts 516 secure the sleeve insert 704 within the sleeve of the left rear swing bar 510.

The inventive coupling, linkage 700 advantageously provides for quick and easy assembly of the components of the undercarriage 102. One simply needs to insert the sleeve inserts 702, 704 within any particular members of the undercarriage assembly requiring pivotable coupling. Upon the securing of a couple of bolts 516, the two components are securely pivotably connected. The coupling linkage 700 thereby obviates the need for assembling the rotationally-related parts at the factory and shipping them in a larger assembled configuration. In addition, unlike other bearings that must be pressed out of the assembly parts, the coupling linkage 700 can quickly and easily be replaced if necessary.

Variable Resistance Member

As has been scientifically proven, the motion of rocking produces a myriad of positive therapeutic effects on the human body. In addition to the simple rocking movement, forces exerted by the human body to cause the rocking motion have the benefit of stimulating the muscles of the user and increases heart rate and blood flow as well. For this reason, it has been found to be advantageous to provide a resistive force to the rocking mechanism so that the user is caused to exert force in order to perform the rocking movement.

Figure 8:
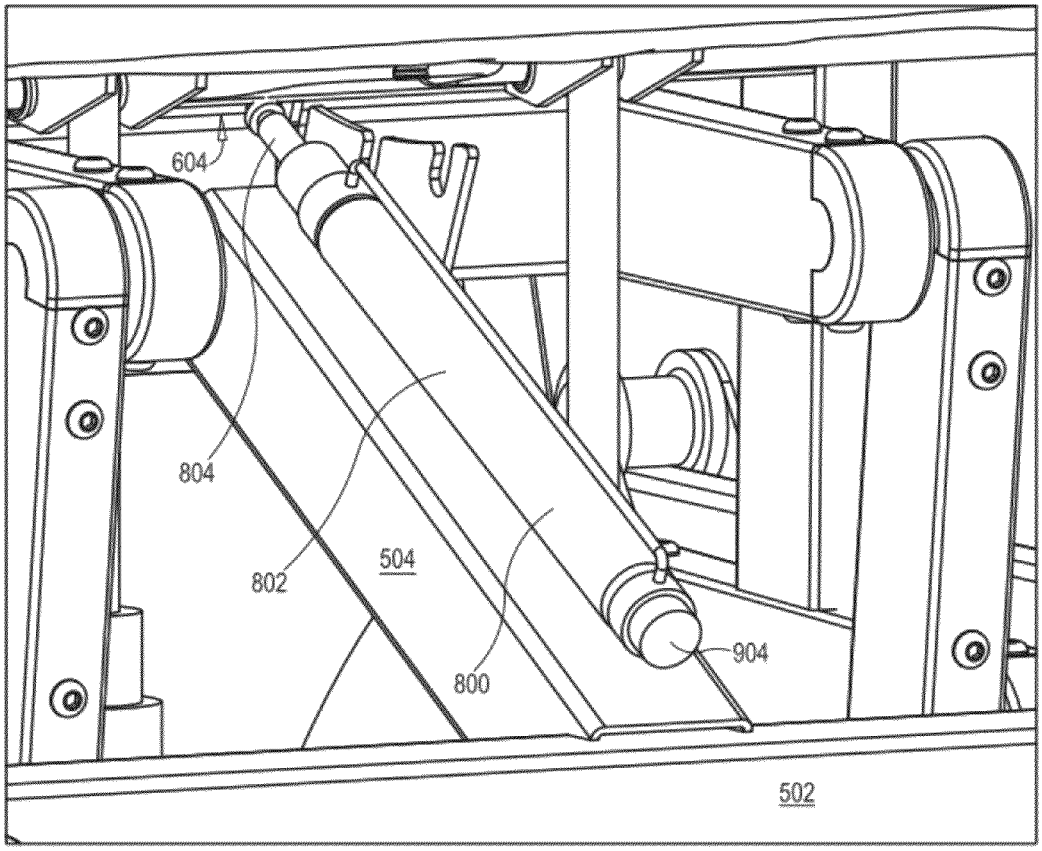
FIG. 8 is a rear-facing fragmentary perspective view of a resistance-producing member coupled to the undercarriage of the mobile patient rocking chair assembly in accordance with the present invention.

Referring now to FIG. 8, a perspective partial close-up view of the undercarriage is shown. A variable resistance member 800 can be seen positioned on top of the crossbar 504, in this particular embodiment, the variable resistance member 800 has a main body section 802 that is fixedly coupled to the fixed crossbar 504. The variable resistance member 800 also has a movable piston 804 that is received by and extends from the body section 802. At its distal end, the movable piston 804 is fixedly coupled to the movable chair coupling platform 604. As was explained above, because of the provision of the swing bars, the chair coupling platform 604 is able to move back and forth relative to the crossbar 504. Therefore, when the chair coupling platform 604 moves, the piston 804 slides into or out of the body section 802 in correspondence to the movement of the chair coupling platform 604.

Figure 9:
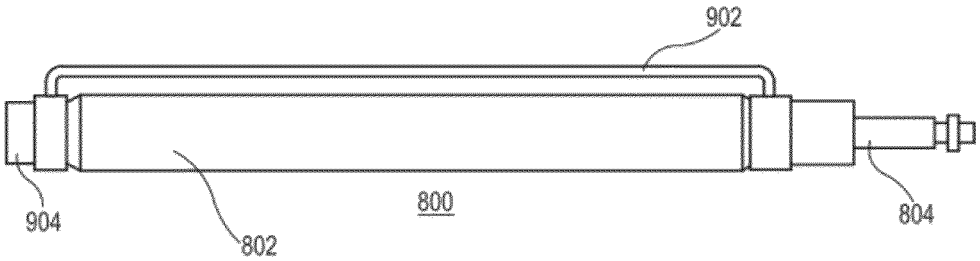
FIG. 9 is an elevational side view of the resistance-producing member of FIG. 9.

FIG. 9 provides an elevational side view of the variable resistance member 800. The type of variable resistance member 800 depicted in FIGS. 8 and 9 is commonly referred to as a "gas spring." in these devices, as the piston 804 moves into and out of the body section 802, a return time 902 allows a gas contained within a first compartment of the body section 802 to transfer to a second compartment of the body section 802. By controlling the resistance applied to this gas-exchange process, the resistance necessary for moving the piston 804 with reference to the body section 802 can also be controlled. More specifically, by making it more difficult for the gas to travel through the return line 902, it also becomes more difficult to move the piston 804 with reference to the body section 802. In contrast, by making it easy for the gas to travel through the return line 902, less force is needed to move the piston 804 with reference to the body section 802. Therefore, the present invention provides a control knob 904 on the variable resistance member 800. By manipulating the control knob 904, the resistance necessary to move the piston 804 with reference to the body section 802 is selectively adjusted.

Once again, referring to FIG. 8, because the body section 802 of the variable resistance member 800 is fixedly coupled to the stationary crossbar 504 and the piston 804 is fixedly coupled to the movable chair coupling platform 604, one simply needs to manipulate the control knob 904 to selectively adjust the amount of force necessary to cause the chair 106 to rock relative the stationary frame section 502, 504.

It should be noted that the embodiment of the variable resistance member 800 is merely exemplary and many other types of devices that can provide a movable resistance can be used and are within the spirit and scope of the present invention.

If the rocking motion is caused by force applied by the user's feet, force applied by the variable resistance member 800 advantageously results in an exercise that focuses on the user's legs. When the exercise handles 202, 204 shown in FIG. 1 are utilized, resistance applied by the variable resistance member 800 advantageously results in an exercise that is directed to the user's arms.

Foot Rest

A footrest 610 is shown in FIG. 6 and is slidably mounted onto the left and right runners 501 and 503, respectively, by a pair of support arms 612 and 614. Each of the support arms 612 and 614 include a set of bearings or rollers 616 and 618 mounted on opposite sides of the left and right runners 501 and 503 and slidable thereon. The footrest 610 thus can be moved back out of the way for a patient to enter or exit the chair. In addition, if the chair hits an obstacle, the footrest can simple slide backwards to avoid damage. The footrest 610, although illustrated in a fixed orientation, also can be adjustable to different heights to accommodate the size of different patients.

As FIG. 6 also shows, when the footrest 610 is slid all the way forward, the support arms 612 and 614 are immediately adjacent the front wheels 104*a* and 104*b*. The adjacency between the support arms 612 and 614 and the front wheels 104*a* and 104*b* ensures that the front wheels 104*a* and 104*b* are aligned in a forward direction and also prevents the front wheels 104*a* and 104*b* from being able to turn as the chair is being moved. The rear wheels 104*c* and 104*d*, of course, remain free to rotate and allow the person pushing the chair to manipulate the trajectory of the chair as it moves.

In other embodiments, the footrest 610 does not prevent rotation of the front wheels 104*a* and 014*b*. For example, FIG. 15 shows a foot rest bracket 1506 that defines a space 1508 around the front wheel 104*a*. Although it cannot be seen in FIG. 15, a similar space allows opposing front wheel 104*b* to freely rotate about its mounting axis.

Drive Motor

Referring once again to FIG. 5, a drive motor 520 is shown coupled to a lower section of the undercarriage 102. The drive motor 518 includes a driving wheel 520 that makes contact with the floor. Upon activation of the drive motor 518, the driving wheel 520 will cause the mobile patient rocking chair assembly 100 to move. In accordance with an embodiment of the present invention, the motor 518 is electrically coupled to a push handle, such as push handle 1002 illustrated in FIG. 10. A button 1004 is electrically coupled to the motor 518 and, when manipulated, causes the motor 518 to rotate the drive wheel 520 and move the mobile patient rocking chair assembly 100 in a direction. This is convenient for the technician charged with moving the mobile patient rocking chair assembly 100. Drive motors, power sources, switches, and driving wheels are well known in the art and, as such, are not described in great detail here.

Rocking Prevention

Figure 17:
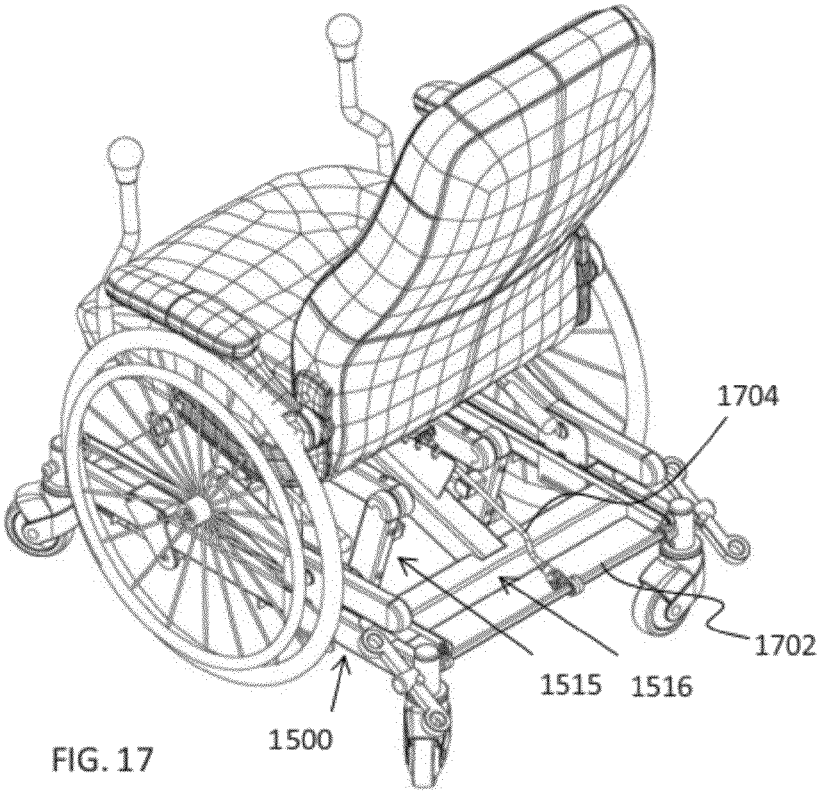
FIG. 17 is a perspective downward-looking left rear view of a mobile patient rocking chair assembly with a rear frame bar that controls a lockout bar that prevents the chair of the mobile patient rocking chair assembly from rocking relative to the frame in accordance with the present invention.
Figure 18:
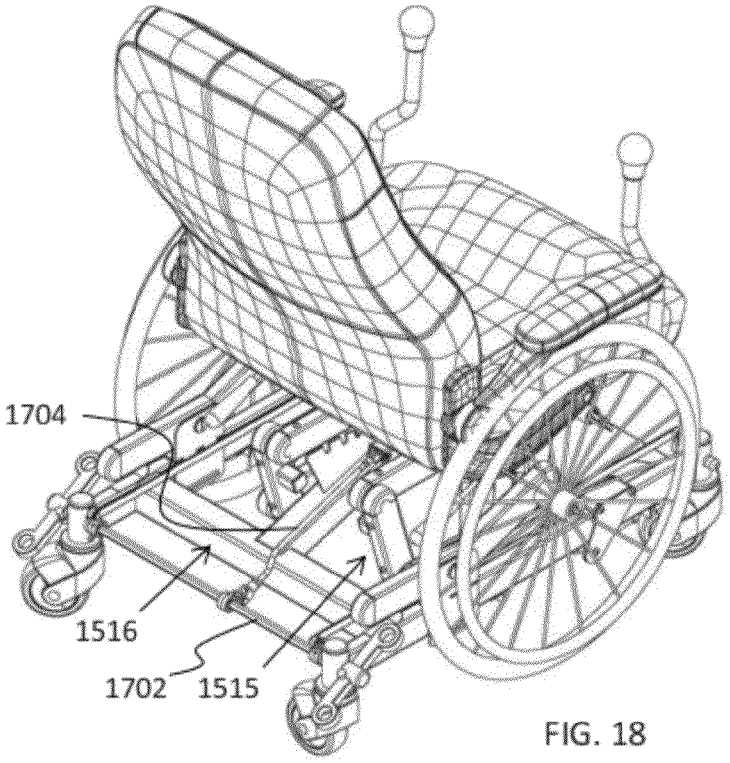
FIG. 18 is a perspective downward-looking right rear view of the mobile patient rocking chair assembly of FIG. 17.

It is anticipated that there will be times when the rocking feature of the present invention will not be desired. For instance, when an attendant is pushing the patient rocking chair assembly 100, continuous rocking by the user would interfere with the attendant's navigation of the patient rocking chair assembly 100. In addition, there may be times, for example, when the user is eating, that the rocking function would not be appropriate. For this reason, embodiments of the present invention provide one or more features for selectively preventing rocking. Referring first to FIGS. 17 and 18, the perspective downward-looking left rear view of the mobile patient rocking chair assembly shows a rotatable frame bar 1702 that is coupled to the frame 1516 of the undercarriage 1500 and spans between the two rear wheels, Near its center, the frame bar 1702 is fixedly coupled to a lockout member 1704. As will now be explained in detail, the lockout member 1704 is a rod that is selectively engageable with the rocking mechanism 1515 and selectively and fixedly couples the frame 1516 to the rocking mechanism 1515 when desired, to prevent rocking of the rocking mechanism 1515 relative to the frame 1516.

Figure 19:
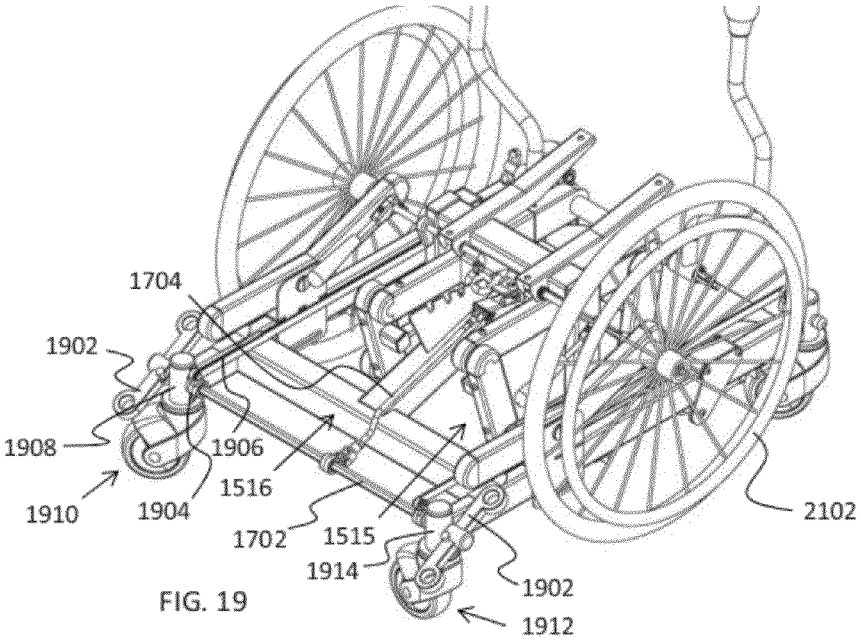
FIG. 19 is a perspective downward-looking right rear view of the mobile patient rocking chair assembly of FIG. 18 with the chair portion removed.
Figure 20:
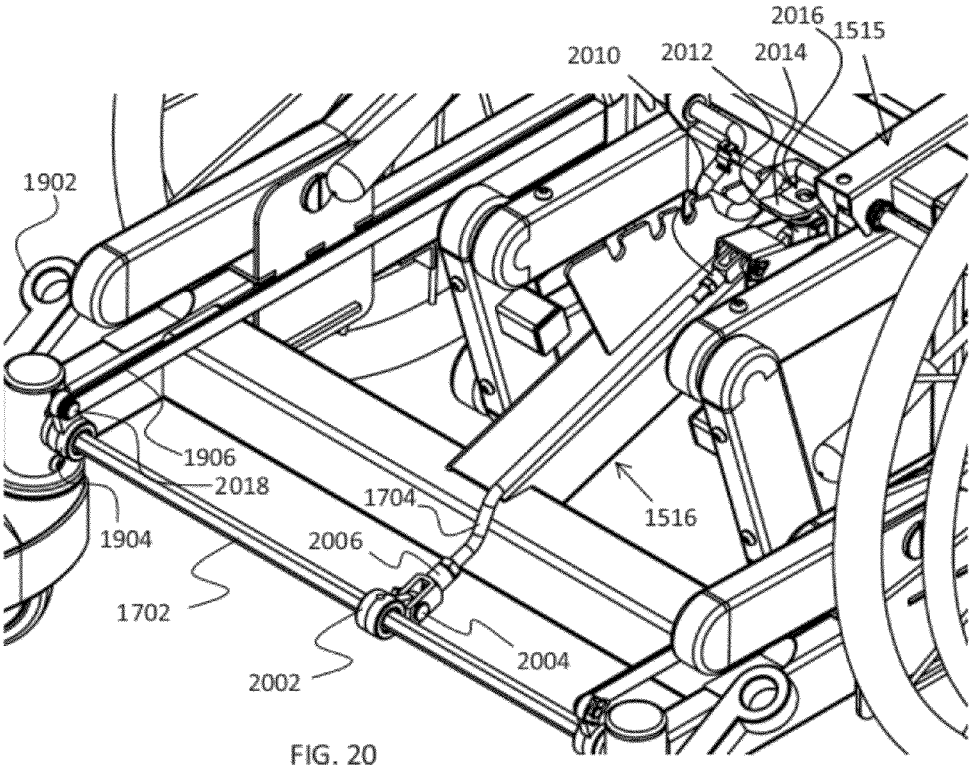
FIG. 20 is a perspective downward looking close-up partial right rear view of the undercarriage of the mobile patient rocking chair assembly of FIG. 17.

FIG. 20 provides a more detailed view of the rocker-stopping assembly in accordance with an embodiment of the present invention. In FIG. 20, a frame bar coupler 2002 is rotationally fixedly coupled to the frame bar 1702 and exhibits a rotation that corresponds to a rotation of the frame bar 1702. Referring briefly to FIG. 19, a pair of foot levers 1902 are shown coupled to the frame 1516 and, more specifically coupled to both ends of the frame bar 1702. The foot levers 1902 allow an attendant to cause a rotation of the frame bar 1702 simply by applying pressure with the attendant's foot.

Referring once again to FIG. 20, a pin 2004 couples the frame bar coupler 2002 to a proximal lockout bar coupler 2006 that is attached to a proximal end of the lockout member 1704. Therefore, because the frame bar 1702 and the frame bar coupler 2002 share an axis of rotation, as the frame bar 1702 rotates about its longitudinal axis, the frame bar coupler 2002 experiences the same rotation and causes the connector pin 2004 to move in an arcuate path around the longitudinal axis of the frame bar 1702. This movement of the connector pin 2004 pushes or pulls the lockout bar 1704 in a mostly longitudinal direction along its length. At the distal end of the lockout bar 1704 is a distal lockout bar connector 2010 that is coupled to a rocking mechanism engagement member 2012 that experiences a corresponding displacement as the lockout bar 1704 moves.

Coupled to the rocking mechanism 1515 of the undercarriage 1500 is a receiver plate 2014 that defines and aperture 2016. The receiver plate 2014 is fixedly attached to the rocking mechanism 1515 so that the rocking mechanism 1515 cannot move without also moving the receiver plate 2014. The aperture 2016 within the receiver plate 2014 is sized to receive at least a portion of the rocking mechanism engagement member 2012. Therefore, movement of the foot levers 1902 rotate the frame bar 1702 which then causes a longitudinal movement of the lockout bar 1704 and moves the engagement member 2012 either into or out of the aperture 2016 in the receiver plate 2014. The movement into the aperture 2016 by the engagement member 2012 either fixedly couples the frame 1516 to the rocking mechanism 1515. This fixed coupling prevents movement of the rocking mechanism 1515 relative to the frame 1516 and, therefore prevents rocking. In contrast, disengagement of the engagement member 2012 from the aperture 2016 of the receiver plate 2014 allows the rocking mechanism 1515 to move independently, although always supported by, the frame 1516. Therefore, the foot levers 1902 advantageously allow an attendant to selectively prevent rocking.

Figure 10:
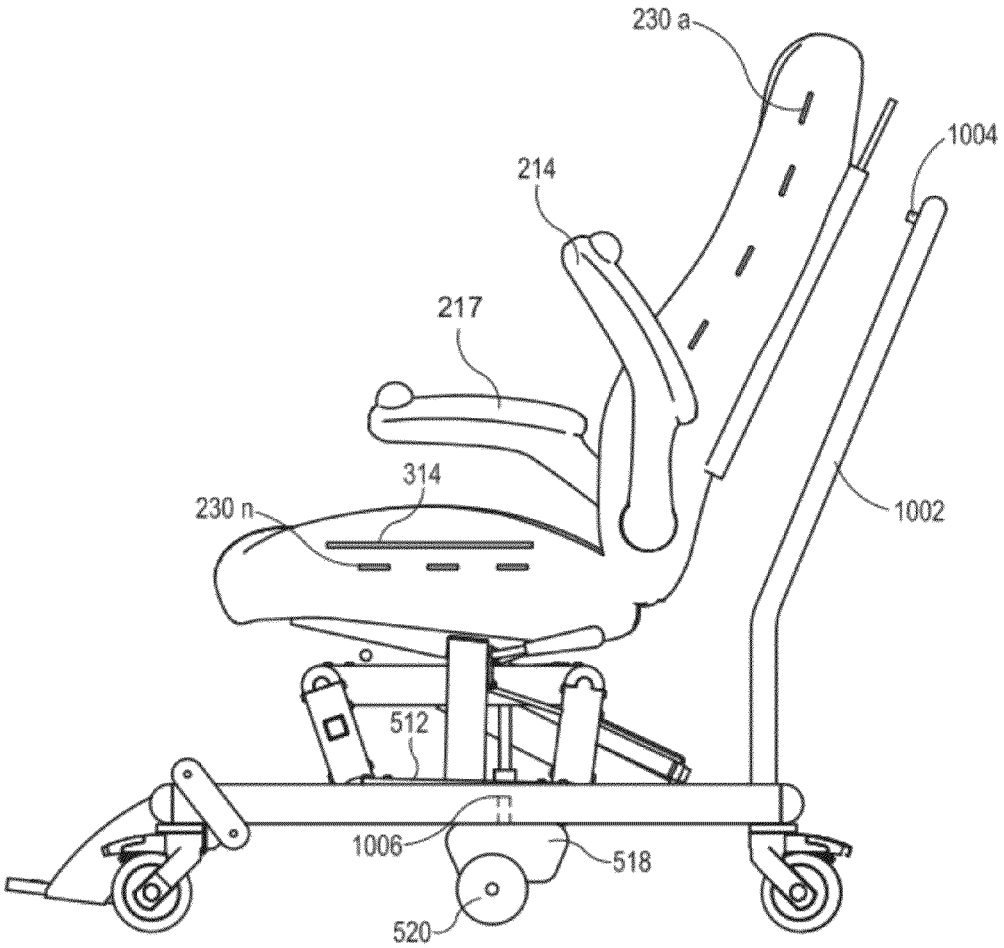
FIG. 10 is an elevational side view of the mobile patient rocking chair assembly of FIG. 1 with a push handle and an electric motor that is able to propel the chair assembly as well as prevent rocking movement while the chair assembly is in motion in accordance with the present invention.

In an alternative embodiment, which is shown in FIG. 10, the left lower swing bar connector 512 passes directly above the motor 518. In accordance with this embodiment, the motor 518 is provided with a pin 1006 that extends upwards from the motor 518 when the motor 518 is activated. The pin 1006 engages with a receiving hole formed in the bottom surface of the left lower swing bar connector 512 and prevents the left tower swing bar connector 512 from moving relative to the lower center support member 502. In this configuration, rocking is halted when the device is moving under power from the motor 518. Preventing rocking motion while moving the inventive mobile patient rocking chair assembly 100 is advantageous. Rocking can cause the device to move in unintended ways, which can have ill effects, for instance, when maneuvering in tight areas.

Of course, a pin extending from the motor 518 is only one possible way of preventing the swinging members of the undercarriage 102 from moving. Many other methods of preventing the chair 106 from rocking while the device is under power is contemplated and within the scope of the present invention. For instance, as shown in FIG. 5, a spring-loaded pin 522 fixedly coupled to the left vertical support member 514 can engage with a hole in the left upper runner 601 and prevent movement of the left vertical support member 514 relative to the left upper runner 601. The spring bias of the pin 522 can be in a direction toward the left upper runner 601 so that the pin 522, unless secured in a non-engaged position, will rest in the hole of the left upper runner 601. In addition, the left upper runner 601 can be provided with a plurality of receiving holes so that the pin 522 can be selectively placed in any one of the receiving holes to secure the chair 106 at one of several possible rocking positions.

In a farther embodiment, the motor 518 can be used to apply a resistive force to the rocking portions of the undercarriage 102. In this embodiment, the motor 518 is selectively adjustable to resist motion by, for instance, the left lower swing bar connector 512. For instance, a wheel coupled to and control by the motor 518 can be placed in contact with the left lower swing bar connector 512. By adjusting the amount of power applied to the motor 518, and thus the wheel, the resistive force applied to the left lower swing bar connector 512 can be selectively determined.

If the rocking motion is caused by force applied from the user's feet, force applied by the motor 518 advantageously results in an exercise that focuses on the user's legs. When the exercise handles 202, 204 shown in FIG. 1 are utilized, resistance applied by the motor 518 advantageously results in an exercise that is directed to the user's arms.

It should be noted that a wheel coupled to and controlled by the motor 518 is merely exemplary and many other types of devices can be used to provide a movable resistance and are within the spirit and scope of the present invention.

Figure 22:
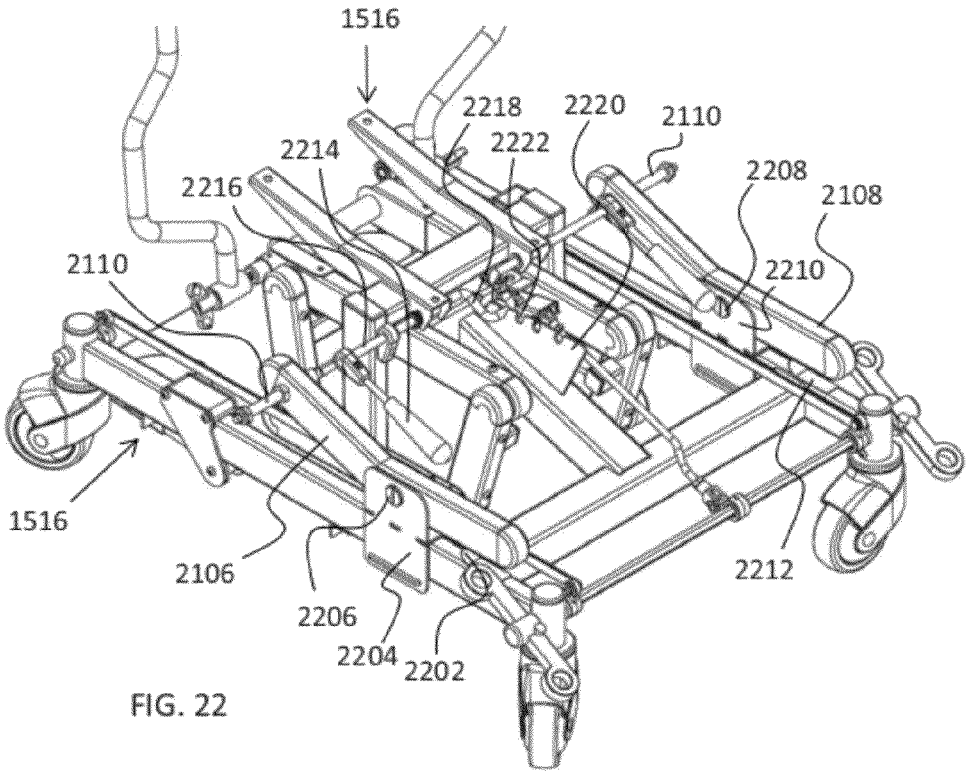
FIG. 22 is a downward-looking left rear view of the mobile patient rocking chair assembly of FIG. 17 with the chair removed to show the wheelchair wheel coupling pivot arms coupled to the frame of the undercarriage as well as a frame plate and handle for coupling the rocking mechanism to the frame in accordance with the present invention.

In yet another embodiment shown in FIG. 22, the rocking mechanism 1515 includes a handle 2214 that is mechanically coupled to a shaft 2216 so that movement of the handle 2214 causes a translated rotation of the shaft 2216 along a longitudinal axis thereof. The shaft 2216 includes a U-shaped bend 2218 along its length wherein an apex of the U-shape is offset from the longitudinal axis of the shaft 2216. When the handle 2214 is manipulated, the shaft 2216 rotates about its longitudinal axis and causes the apex of the U-shaped bend 2218 to move in an arcuate path around the longitudinal axis of the shaft 2216.

The frame 1516 is provided with a receiving plate 2220 fixedly attached thereto. The frame plate 2220 has formed therein a series of receiving areas 2222 that are sized and shaped to receive a portion of the U-shaped bend 2218. Mating the U-shaped bend 2218 with one of the receiving areas 2222 within the frame plate 2220 mechanically couples the rocking mechanism 1515 to the frame 1516 and prevents rocking from taking place. Of course the bend feature 2218 does not have to be in the shape of a U. Having the ability to mechanically coupled to the frame 1516 and the rocking mechanism 1515 is advantageous during times when rocking is not desired, such as while seated at a dinner table or when attempting to exit the chair 106, among many other situations. Advantageously, because the receiving plate 2220 provides a plurality of receiving areas 2222, a patient seated in the chair 106 (not shown in FIG. 22) can select between several angles of recline while seated in the chair 106.

Back Adjustment Angle

Figure 11:
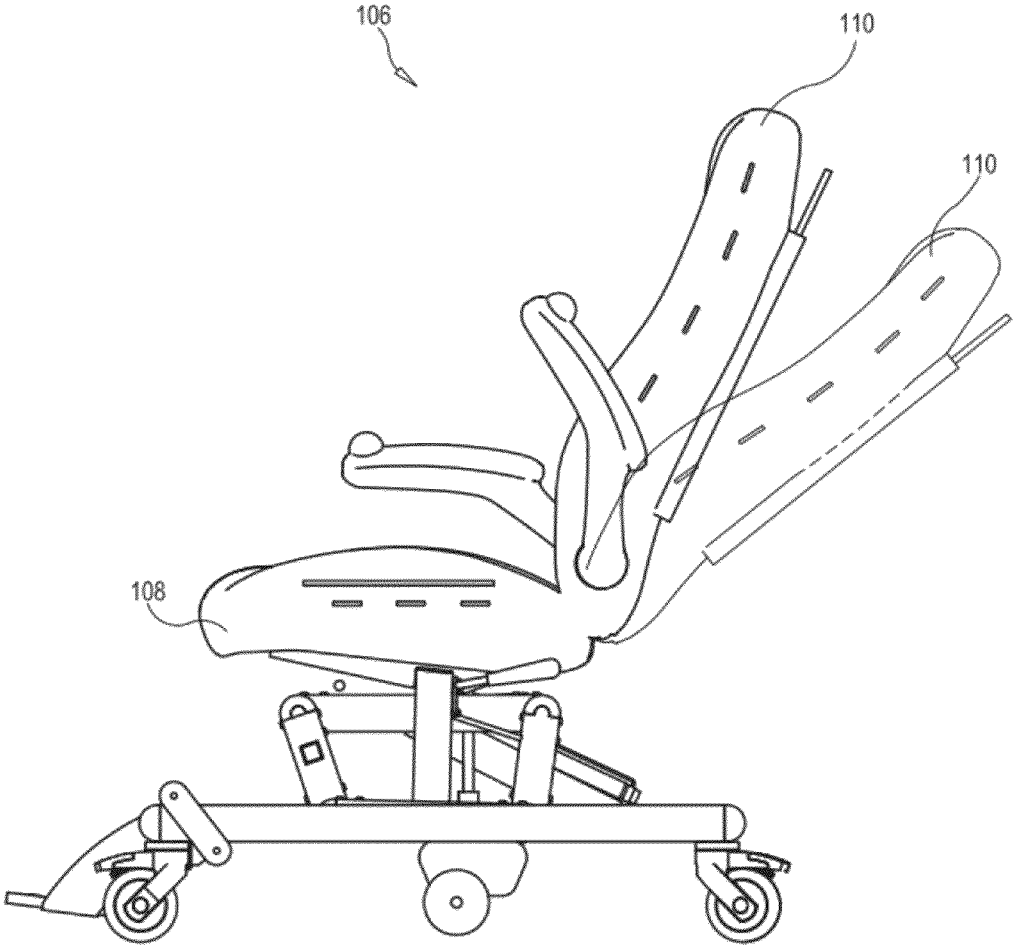
FIG. 11 is an elevational side view of the mobile patient rocking chair assembly of FIG. 1 with an adjustable back portion of the chair in accordance with the present invention.

In accordance with an embodiment of the present invention, and as shown in FIG. 11, the back portion 110 has an angle that is selectively adjustable with relation to the seat portion 108. This adjustment is similar to that of the seat found in an auto bile. Adjustment of the back portion 110 with relation to the seat portion 108 of the chair 106 advantageously provides the patient with a range of choices for the most comfortable sitting position.

Wheel Chair Wheels

Figure 12:
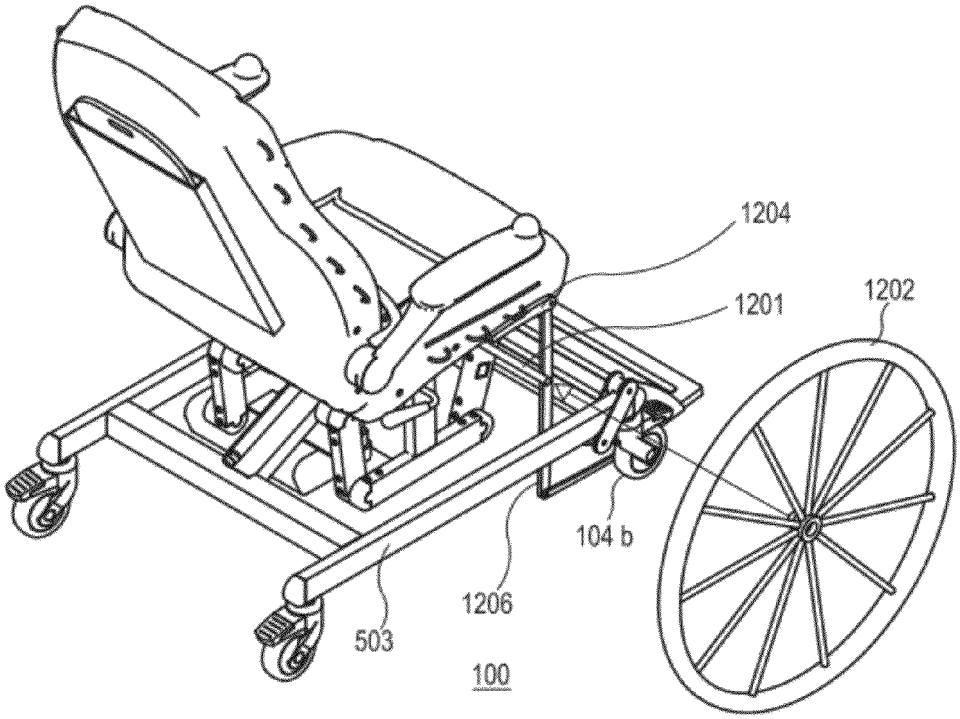
FIG. 12 is a perspective right rear view of the mobile patient rocking chair assembly of FIG. 1 with a wheelchair wheel aligned with an axle in accordance with the present invention.

Referring now to FIG. 12, the mobile patient rocking chair assembly 100 is shown in a downward-looking rear perspective view. In this embodiment, the mobile patient rocking chair assembly 100 features a coupling pin 1201 that couples to a large wheelchair type wheel 1202. The term "wheelchair type wheel," as used herein, is intend to indicate a wheel that can be manipulated by a patient's hands to propel the chair in a desired direction. The coupling pin 1201 can be inserted into the center of the wheelchair type wheel 1202 and the wheel 1202 secured so that it is fixedly rotationally coupled onto the coupling pin 1201. Although not illustrated, a second wheel could be installed on the left side of the mobile patient rocking chair assembly 100.

Figure 13:
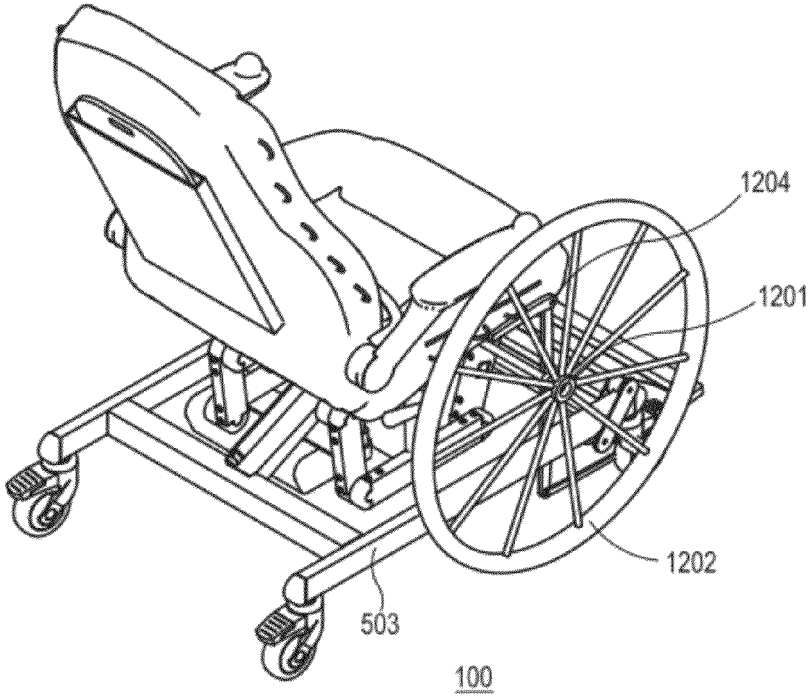
FIG. 13 is a perspective right rear view of the mobile patient rocking chair assembly of FIG. 1 with a wheelchair wheel installed on an axle in accordance with the present invention.

When in position, as shown in FIG. 13, the wheelchair type wheel 1202 extends further below the right runner 503 than does the left front wheel **104*b* (shown best in FIG. 12), Advantageously, as with a standard wheelchair, the larger wheels 1202** allow a patient to easily maneuver their chair through whatever space is necessary/desired and obviates the need for an attendant to push it.

To assist with installing the wheelchair type wheel 1202 onto the pin 1201, the mobile patient rocking chair assembly 100 is provided with a lever 1204 that, when operated, drives a lift member 1206 in a downward direction. When the lift member 1206 makes contact with the ground, further movement of the lever 1204 causes the front wheel **104*b* to lift off of the ground. Of course, this also lifts the coupling pin 1201 making it easy to slip the wheelchair type wheel 1202 onto the coupling pin 1201**.

Figure 21:
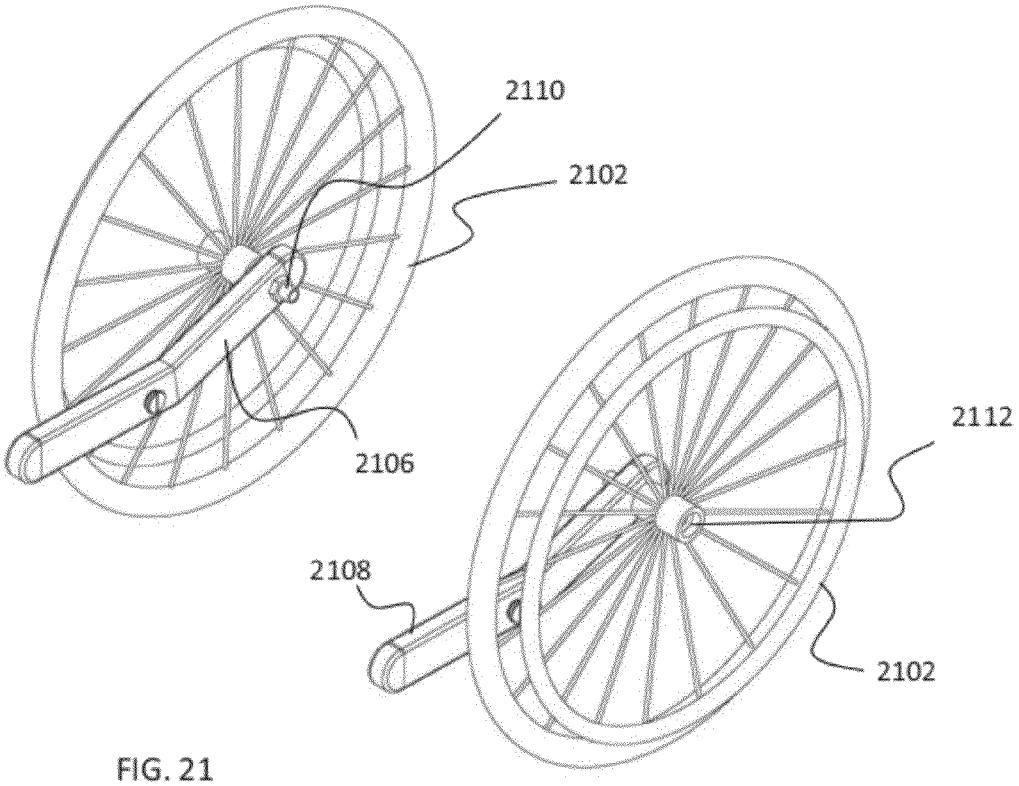
FIG. 21 is a perspective view of two wheelchair wheels coupled to pivot arms through quick connect couplers in accordance with the present invention.

In yet another embodiment of the present invention, as shown in FIG. 21, a pair of wheelchair wheels 2102 are coupled to a pair of spring-loaded levers, which are shown in FIG. 21 as pivot arms 2106 and 2108. Each of the pivot arms 2106 and 2108 is provided with an axle 2110 that extends away from each arm and provides a location for attaching the wheelchair wheels 2102. In a preferred embodiment, however, the axle 2110 is fixedly attached to the wheelchair wheels 2102 and removably couples to receiving portions of the pivot arms 2016 and 2108, the receiving areas being those locations shown receiving and holding the axles 2110 in FIG. 22. In this embodiment, where the axle 2110 remains attached to the wheelchair wheels 2102, when the wheelchair wheels 2102 are removed, there are no axles extending from the chair.

To facilitate attachment, each of the wheel chair wheels 2102 features a quick lock 2112 that provides for quick removable coupling of the wheelchair wheel 2102 to the axle 2110 or of the axle to the spring-loaded pivot arms 2106 and 2108. Quick couples are couplers that can be manipulated with a single hand and/or without tools, for example, one known quick coupler, manufactured by BIG SKY PRECISION, INC, of Manhattan, Mont., called the SKY LOC BUTTON-HANDLE, includes a shaft with a push-button on one end and two opposing members on the opposite end that are retracted by depression of the push-button. Other quick couplers are well known in the art and will not be explained in great detail here. The invention, however, does not require quick couplers and any mode of connecting the wheelchair wheel 2102 to the axle 2110 can be used.

FIG. 22 illustrates how the spring-loaded pivot arms 2106 and 2108 couple to the frame 1516. The frame 1516 is provided with a left bracket 2204 with a pivot pin 2206 that passes through one side of the left bracket 2204, through the left pivot arm 2106, and through the other side of the left bracket 2204. The spring-loaded pivot arm 2106 pivots upon pivot pin 2206 and is spring biased by a bias member, e.g., a spring, 2202 in a direction that biases the axle 2110 in a downward direction toward the floor. The bias member 2202 can be any mechanism that exerts an upward force on the side of the spring-loaded pivot arm 2106 and 2108 that is opposite the wheelchair wheel axle 2110 or exerts a downward force on the side of the spring-loaded pivot arm 2106 and 2108 that has the wheelchair wheel axle 2110 coupled thereto.

Similarly, the frame 1516 is provided with a right bracket 2208 with a pivot pin 2210 that passes through one side of the right bracket 2208, through the right pivot arm 2108, and through the other side of the right bracket 2208. The spring-loaded pivot arm 2108 pivots upon pivot pin 2210 and is spring biased by a spring 2212 in a direction that biases the axle 2110 in a downward direction toward the floor.

Referring now back to FIG. 19, the wheelchair wheels 2102 are coupled to the wheelchair wheel axles 2110 of the spring-loaded pivot arms 2106 and 2108. Because the springs 2202 and 2212 bias the spring-loaded pivot arms 2106 and 2108 in a direction that exerts a downward force on the wheelchair wheel axles 2110, there is also a biasing force exerting a downward pressure on the wheelchair wheels 2102. This downward force advantageously maintains contact between the wheelchair wheels 2102 and the floor. It allows a patient to easily propel and maneuver the mobile wheelchair assembly 100 the way a normal wheelchair is to be operated.

Advantageously, to remove the wheelchair wheels 2102, an operator simply needs to place pressure, e.g., by pressing down with their foot, on the spring-biased end of the spring-loaded pivot arms 2106 and 2108. When sufficient pressure is placed on the spring-biased end of the spring-loaded pivot arms 2106 and 2108 to overcome the biasing force, the wheelchair wheels 2102 lift off of the ground slightly and allow the operator to easily disconnect them from the axles 2110. This easy connection and disconnection arrangement provides tremendous advantages in that there is no need to lift the chair from the ground in order to install or disconnect the wheelchair wheels 2102. This is particularly useful when a patient needs to be transferred laterally from the chair to a nearby object such as, for example, a bed or a toilet. More specifically, referring briefly back to FIG. 13, it can be seen that the wheelchair wheel 1202 extends above the seating surface. Without removing the wheelchair wheel 1202, the patient cannot be transferred laterally, sideways from the seat, without lifting them up and over the wheelchair wheel 1202. This would create a great deal of difficulty on the attendants and introduce an element of danger to the patient. Because the present invention, as shown in FIG. 19, allows the wheelchair wheels 2102 to be removed quickly and easily, for the first time, the chair can be provided to the patient that allows them to navigate and also allows them to bury easily be maneuvered up to an adjacent structure and transferred with extreme ease and safety.

Figure 23:
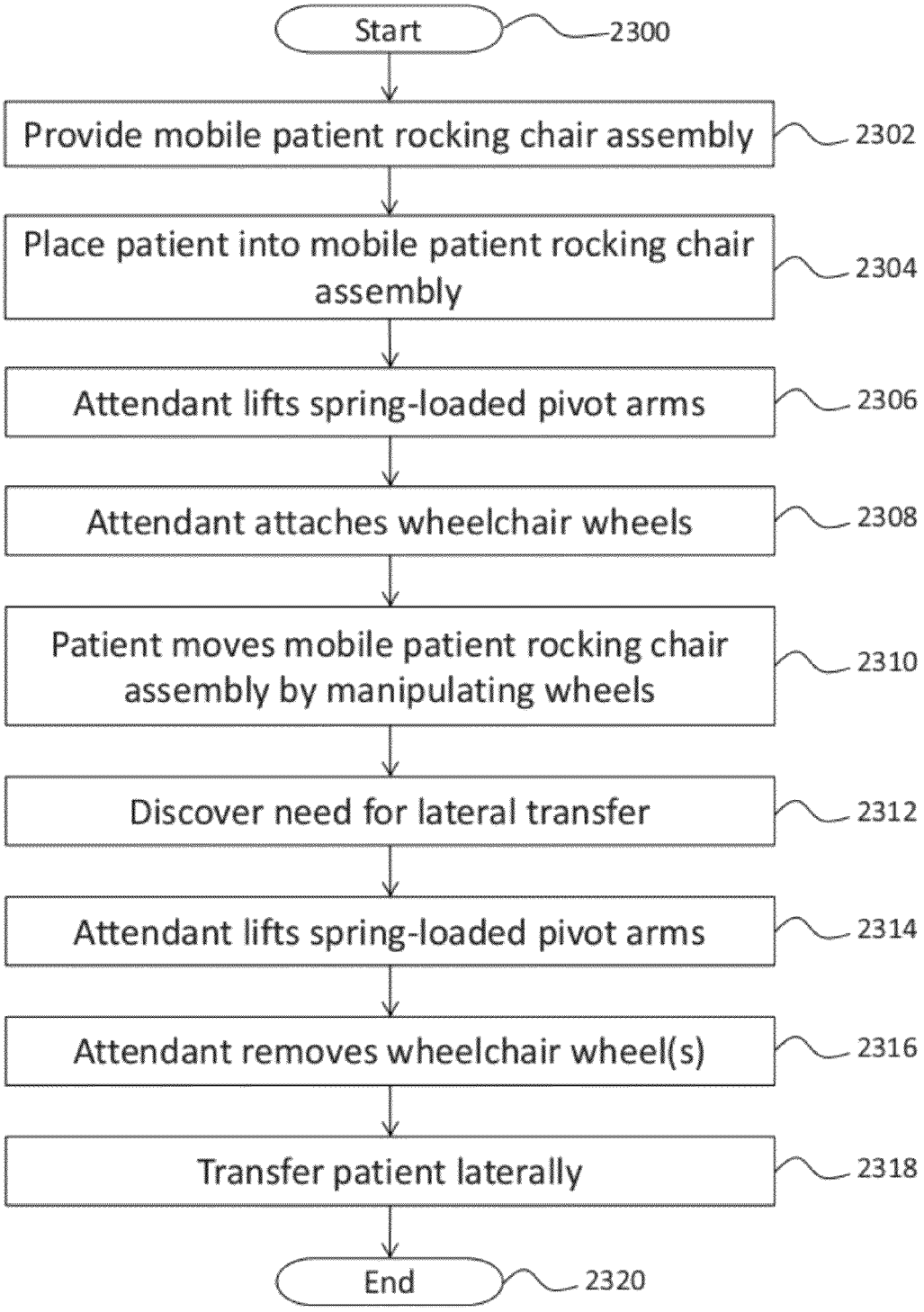
FIG. 23 is a process flow diagram illustrating a method of attaching and removing wheel chair wheels from a mobile patient rocking chair assembly.

FIG. 23 shows an exemplary process flow diagram for utilizing the removable wheelchair wheels of the present invention. The process begins at step 2300 and move directly to step 2302 where a mobile patient rocking chair assembly 100 is provided without wheelchair wheels. In step 2304, a patient is placed into the chair 106 of the mobile patient rocking chair assembly 100. In step 2306, the attendant places pressure, e.g., by pressing down with his foot, on one of the spring-biased ends of the spring-loaded pivot arms 2106 or 2108. When sufficient pressure is placed on the spring-biased end of the spring-loaded pivot arm 2106 or 2108 the attendant is able to and does attach a wheelchair wheel 1202, 2102 to the wheel axle 2110 by using a quick connector 2112 provided at the hub of the wheelchair wheel 1202, 2102 in step 2308. In the same step, 2308, the attendant installs the opposing wheelchair wheel 1202, 2102. In step 2310, the patient uses the wheelchair wheels 1202, 2102 to navigate the chair along any path desired by the patient. In step 2312, the patient or the attendant recognizes a need to transfer the patient from the mobile patient rocking chair assembly 100 to another patient support structure, for example, the patient's bed. In step 2314, the attendant places pressure, e.g., by pressing down with his foot, on one or both of the spring-biased ends of the spring-loaded pivot arms 2106 and 2108. When sufficient pressure is placed on the spring-biased end(s) of the spring-loaded pivot arms 2106 or 2108, in step 2316, the attendant is able to and does remove one or both of the wheelchair wheels 1202, 2102 from the wheel axle 2110 by using a quick connector 2112 provided at the hub of the wheelchair wheels 1202, 2102. In step 2318, the patient is transferred laterally from the chair 106 of the mobile patient rocking chair assembly 100 and into the target patient support structure. The process ends at step 2320.

Tray

Figure 14:
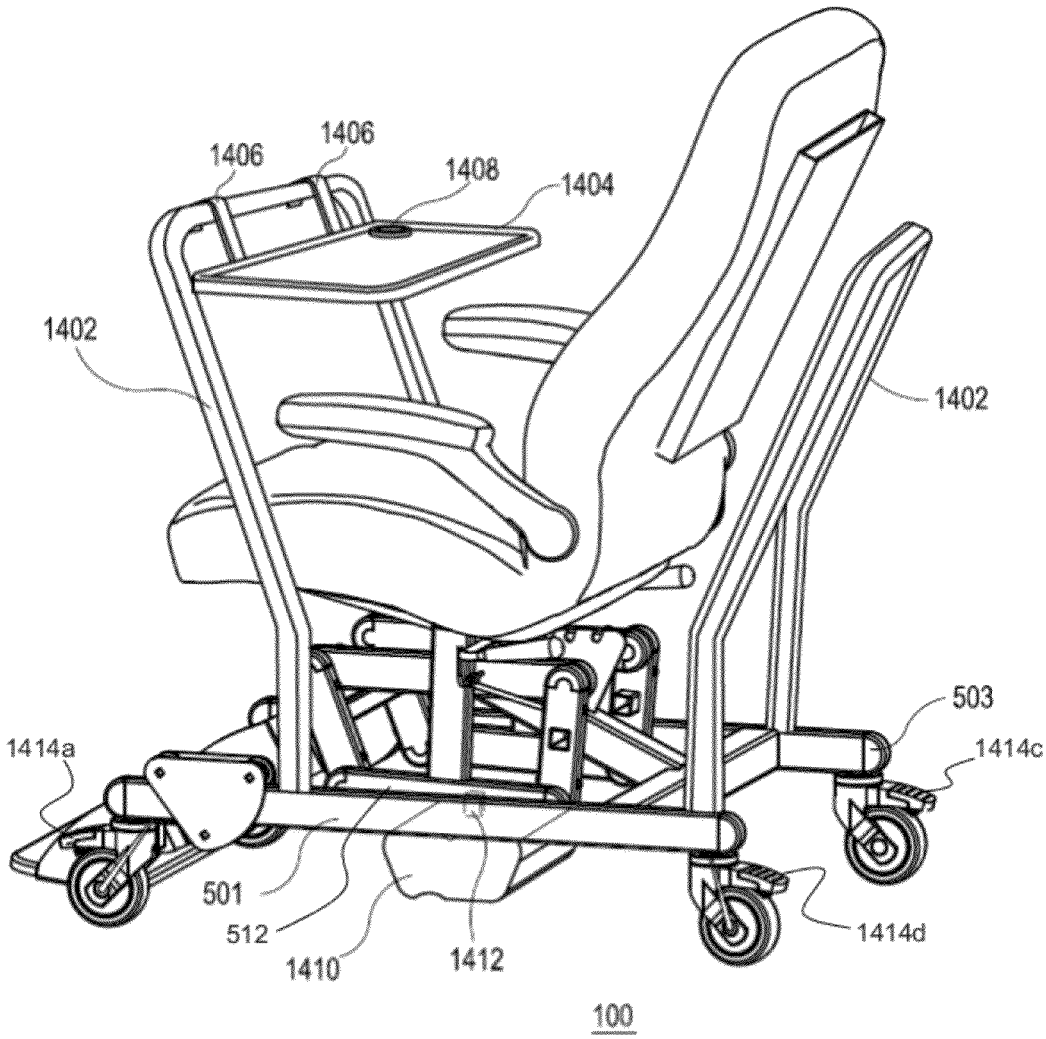
FIG. 14 is a perspective left-side view of a mobile patient rocking chair assembly having a food tray and food tray support bar that converts to a push handle as well as a mechanism that prevents rocking movement when the wheels are not in a locked position in accordance with the present invention.

Looking now to FIG. 14, the mobile patient rocking chair assembly 100 is shown in a left-side perspective view where a tray 1404 is supported by a support bar 1402. The tray 1404 is provided with a pair of clips 1406 that coupled to an upper portion of the support bar 1402. When in use, the tray 1404 provides a surface for supporting food and beverages for the patient to enjoy. Tray 1404 includes a beverage holder 1408 that provides a recessed area for securing a drink.

When not in use, the tray 1404 can be easily stored in a storage compartment 402 provided on a backside of the back portion 110 of the chair 106. The support bar 1402, which is coupled to and supported by the left runner 501 and the right runner 503 at a front portion thereof can be removed and repositioned to a rear portion of the left runner 501 and the right runner 503, which is also shown in FIG. 14. When moved to the rear position, the support bar 1402 is advantageously able to serve as a push handle for moving the mobile patient rocking chair assembly 100.

Locking Wheels

It is anticipated that there will be times when lateral movement, i.e., roiling, of the present invention will not be desired. For instance, when an attendant is not around to supervise the patient or the when the mobile patient rocking chair assembly 100 is located near an incline. In addition, there may be times when the patient is someone that needs to have their movement restricted. For this reason, embodiments of the present invention provide a feature for selectively preventing locking of one or more of the wheels 104*a-n*.

Referring to FIG. 19, a pair of foot levers 1902 are shown coupled to the frame 1516 of the undercarriage 1500 and, more specifically, coupled to both ends of a frame bar 1702. The foot levers 1902 allow an attendant to cause a rotation of the frame bar 1702 simply by applying pressure with the attendant's foot. The frame bar 1702, in the embodiment shown, is provided with a plurality of flat spots around its outer surface. FIG. 19 also shows a wheel coupler 1904 rotationally fixedly coupled to the frame bar 1702.

Located between the foot lever 1902 and the wheel coupler 1904 is an upper control portion 1908 of a caster 1910. Casters are well known in the art and feature a wheel that is rotationally connected to a frame in a way that allows the wheel to rotate as it travels along the surface and also rotate about its connection point to the frame. These casters are commonly found on, for example, the front of the grocery shopping carts and on hospital beds. The casters, however, do not necessarily have to be rotationally connected so that they can rotate about the frame to which they are attached. Instead, the casters can be fixedly connected in a single position like, for example, the rear wheels of a grocery shopping carts.

In accordance with an embodiment of the present invention the upper control portion 1908 of the caster 1910 includes a locking feature that can prevent the wheel 1912 from rotating and, in accordance with some embodiments, can prevent the steering ability of the caster, i.e., rotation of the entire caster with reference to the frame 1516. One exemplary known caster is part number 5444PJP100R36-32S30 manufactured by TENTE CASTERS, Inc. Other such casters are manufactured by RHOMBUS CASTERS, Inc., among others. Rotation of the frame bar 1702 which passes through the upper control portion 1908 of the caster 1910 engages and disengages the locking feature of the caster 1910.

In addition to caster 1910 at its upper control portion 1908, the frame bar 1702 also passes through the opposing rear caster 1912 and its upper control portion 1914. The opposing rear caster 1912 can also be locked by the rotation of the frame bar 1702 which is affected by the foot lever 1902.

As an example of the advantageous features of a locking caster 1910, it is supposed that an attendant wishes to leave a patient in the chair with the rocking ability enabled. In this instance, the attendant might want to ensure that the chair does not move while it is being rocked. Advantageously, the attendant only needs to activate the foot lever 1902 which not only locks the rotating ability of at least one of the wheels, as explained above, it also disengages the frame 1516 from the rocking mechanism 1515 to allow rocking to take place.

Referring once again to FIG. 20, a pin 2018 couples the wheel coupler 1904 to a proximal end of a wheel-coupling rod 1906. Therefore, because the frame bar 1702 and the wheel coupler 1904 share an axis of rotation, as the frame bar 1702 rotates about its longitudinal axis, the wheel coupler 1904 experiences the same rotation and causes the connector pin 2018 to move in an arcuate path around the longitudinal axis of the frame bar 1702. This movement of the connector pin 2018 pushes or pulls the wheel-coupling rod 1906 in a mostly laterally direction along its length. At the distal end of the wheel-coupling rod 1906 is a front caster. By providing the wheel-coupling rod 1906, movement of the foot lever 1902 can effectively lock both the rear and front casters in a single motion.

Therefore, embodiments of the present invention allow for multiple modes of operation in terms of the wheels. For example, in a first mode, when the attendant activates the foot lever 1902, all four wheels lock both in frame rotation, i.e., swivel relative to the frame, and in rolling rotation, i.e., rolling about a surface. In a second mode when the foot lever 1902 is in the opposite position, all four wheels are allowed to move in and unrestricted fashion. In yet another mode, one of the wheels/casters is in a fixed position relative to the frame. In other words, it is not able to swivel. This is similar to the back wheel of a grocery cart, and allows for improved travel of the inventive chair assembly. In some embodiments, a foot lever is present on the front of the frame 1516 and is accessible by the patient seated within the chair. In this embodiment, the patient is able to selectively engage and disengage a locking feature of the wheels/casters.

As was explained above, the frame bar 1702 is fixedly coupled to a lockout bar 1704, which is selectively engageable with the rocking mechanism 1515 and selectively and fixedly couples the frame 1516 to the rocking mechanism 1515. Because the lockout bar 1704 and the wheel-coupling rod 1906 are both activated by rotation of the frame bar 1702, manipulation of the foot lever 1902 has the ability of advantageously preventing rocking of the chair 106 any time the wheels are free to roll. Conversely when the foot lever 1902 is in the locked position, i.e., the wheels are locked and prevented from providing the patient chair with lateral motion across a supporting surface, the rocking feature is unlocked and the chair 106 is free to rock back and forth relative to the frame 1516. In other words, when the wheels are unlocked, the chair is unable to rock and when the wheels are locked, the chair is able to rock in both functions are selected simply by depressing the foot lever 1902.

In a second embodiment for allowing controlled locking of the wheels, and as is shown in FIG. 14, the left lower swing bar connector passes directly above a motion preventer 1410. In accordance with an embodiment of the present invention, the motion preventer 1410 is provided with a pin 1412 that extends upwards from the motion preventer 1410. The pin 1412 engages with a receiving hole formed in the bottom surface of the left lower swing bar connector 512 and prevents the left lower swing bar connector 512 from moving relative to the left runner 501.

Each wheel 104*a-d* is provided with a brake 1414*a-d* that, when operated, prevents rotation of the wheel 104*a-d* to which it is coupled. Each brake 1414*a-d*, in the particular embodiment shown in FIG. 14, has a lever 1416*a-d* that has a locked position for preventing movement of its respective wheel 104*a-d*. In addition, each brake lever 1416*a-c* is electrically coupled to the motion preventer 1410. In accordance with this embodiment, the motion preventer 1410 will not disengage the pin 1412 from the left lower swing bar connector 512 until at least one of the brake levers 1416*a-d* indicated that it is in a locked position, thereby able to prevent movement of its wheel. This feature ensures that a patient rocking in the mobile chair will not cause the chair to move. Preventing rocking motion while the inventive mobile patient rocking chair assembly 100 is mobile is advantageous. Rocking can cause the device to move in unintended ways and can be particularly dangerous near stairs.

Of course, a pin extending from the motion preventer 1410 is only one possible way of preventing the swinging members of the undercarriage 102 from moving. Many other methods of preventing the chair 106 from rocking while the wheels are unlocked is also contemplated.

Leg Rest

In accordance with the present invention, an adjustable leg rest can be coupled to the seat portion 108 of the chair 106. The leg rest can resemble that of a typical recliner and provide a support for the lower portion of the user's legs.

Front Tilt

Figure 24:
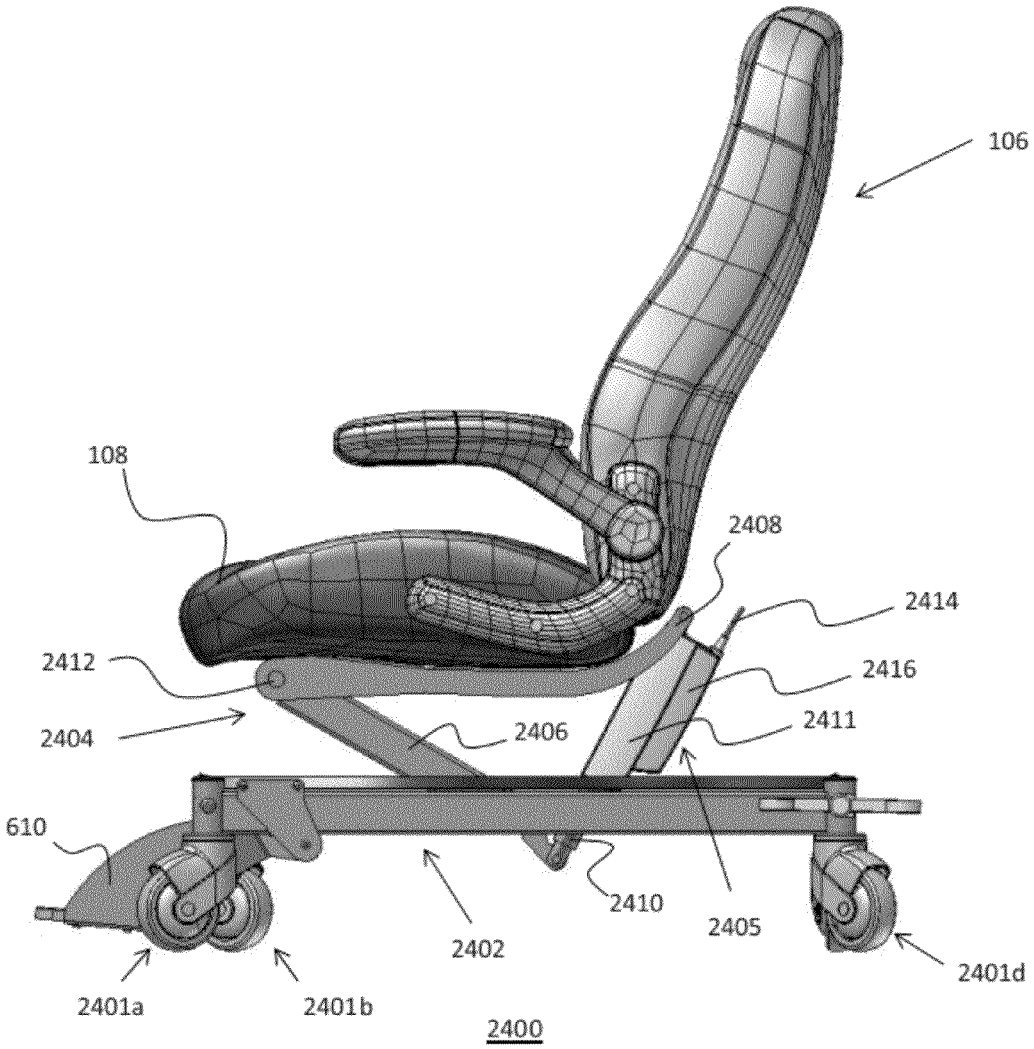
FIG. 24 is an elevational left side view of a mobile patient chair assembly in an upright position in accordance with the present invention.

A further embodiment of a mobile patient rocking chair assembly 2400, as shown in FIG. 24, includes an undercarriage 2402 that supports a chair 106 and features a set of wheels 104*a-d* (shown as casters in FIG. 24) below that provide mobility to the undercarriage 2402. The chair 106 is used to support a person when placed in the inventive patient rocking chair assembly 2400. Although four wheels are show, the invention is not so limited and can utilize any number of wheels, rollers, casters, and other elements to provide mobility.

Figure 25:
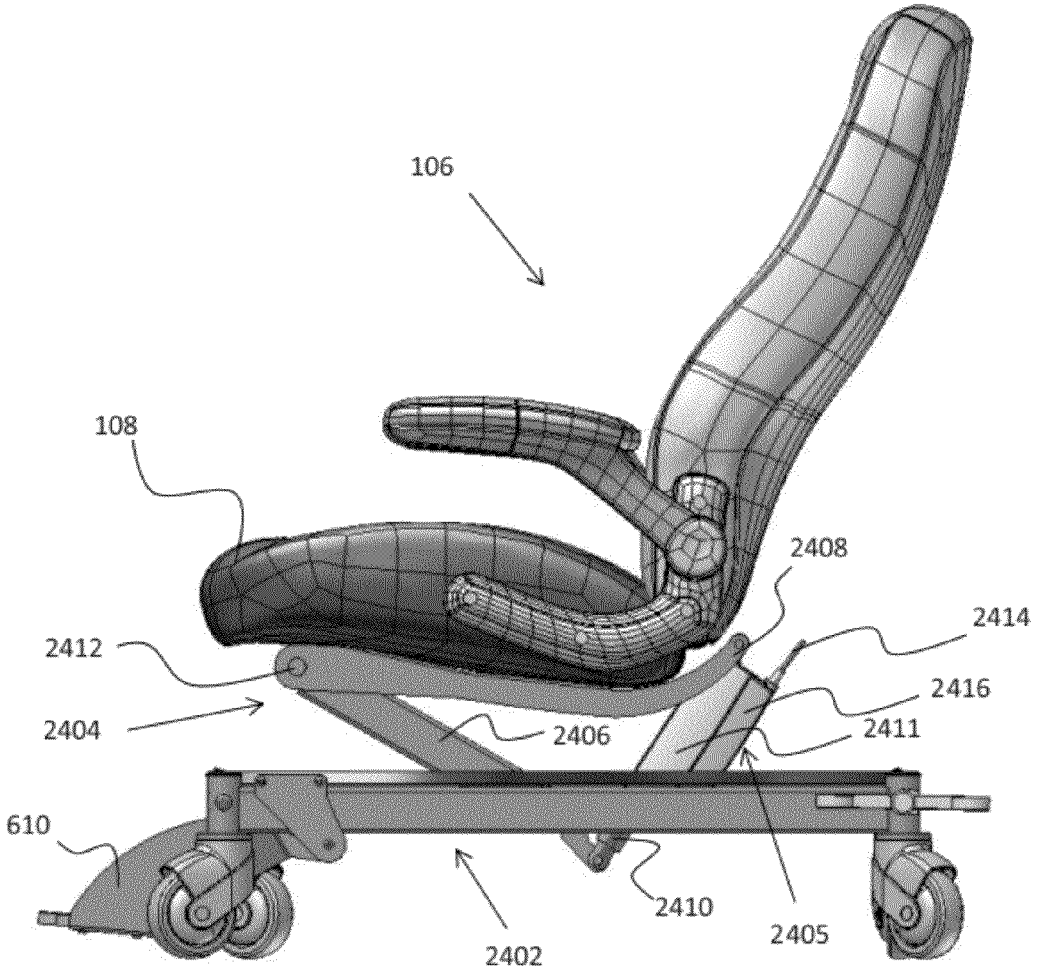
FIG. 25 is an elevational left side view of the mobile patient chair assembly of FIG. 24 in a partially reclined position.
Figure 26:
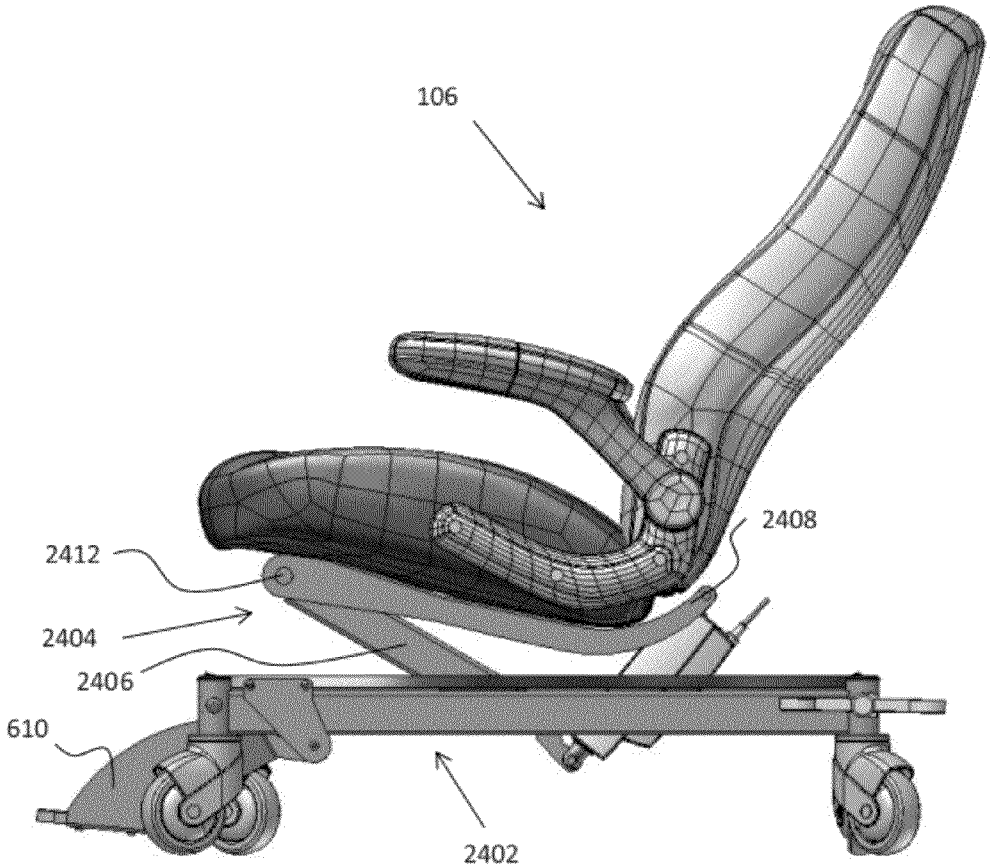
FIG. 26 is an elevational left side view of the mobile patient chair assembly of FIG. 24 in a fully reclined position.

The connection between the chair 106 and the undercarriage 2402 is facilitated by a pivoting subassembly 2404 that includes a front frame brace 2406 coupled to an upper pivoting member 2408 upon which the chair 106 rests. The front frame brace 2406 and the upper pivoting member 2408 are coupled at a pivot point 2412. At the rear of the upper pivoting member 2408 is an actuator 2405 that controls the amount of pivot between the front frame brace 2406 and the upper pivoting member 2408. Because the chair 106 is mechanically coupled to the upper pivoting member 2408, when the actuator 2405 causes the upper pivoting member 2408 to move relative to the front frame brace 2406, the chair 106 experiences a corresponding movement in tilt angle. FIGS. 24-26 illustrate an exemplary range of tilt angles that the chair 106 can experience under the control of the actuator 2405.

In accordance with an embodiment of the present invention, the actuator 2405 is electrically powered and includes a control shaft 2410 that extends from or retracts within the control shaft housing 2411. The actuator 2405 also includes a control and power supply 2416 and a control switch 2414. When the control switch 2414 is activated, the power supply 2416 causes the control shaft 2410 to extend from or retract into the control shaft housing 2411, thereby causing a corresponding angular adjustment between the front frame brace 2406 and the upper pivoting member 2408. For example, FIG. 24 shows the control shaft 2410 in a fully extended position placing the upper pivoting member 2408 in a substantially horizontal position, which also places the seat portion 108 of the chair 106 in a substantially horizontal position. FIG. 25 shows the control shaft 2410 partially retracted into the control shaft housing 2411, which movement causes the upper pivoting member 2408 to pivot at the pivot point 2412 in tilt the chair 106 into a partially reclined position. FIG. 26 shows the control shaft 2410 fully retracted into the control shaft housing 2411, thereby placing the chair 106 into a fully reclined position. Advantageously, because the upper pivoting member 2408 pivots at pivot point 2412, which resides substantially directly below the patient's knee, the patient's feet can remained rested upon the foot rest 610 regardless of the angle of the upper pivoting member 2408.

In other embodiments, the control switch 2414 is accessible to or can be controlled by a patient seated within the chair 106. In this embodiment, the patient can dictate the recline angle of the chair 106.

Figure 27:
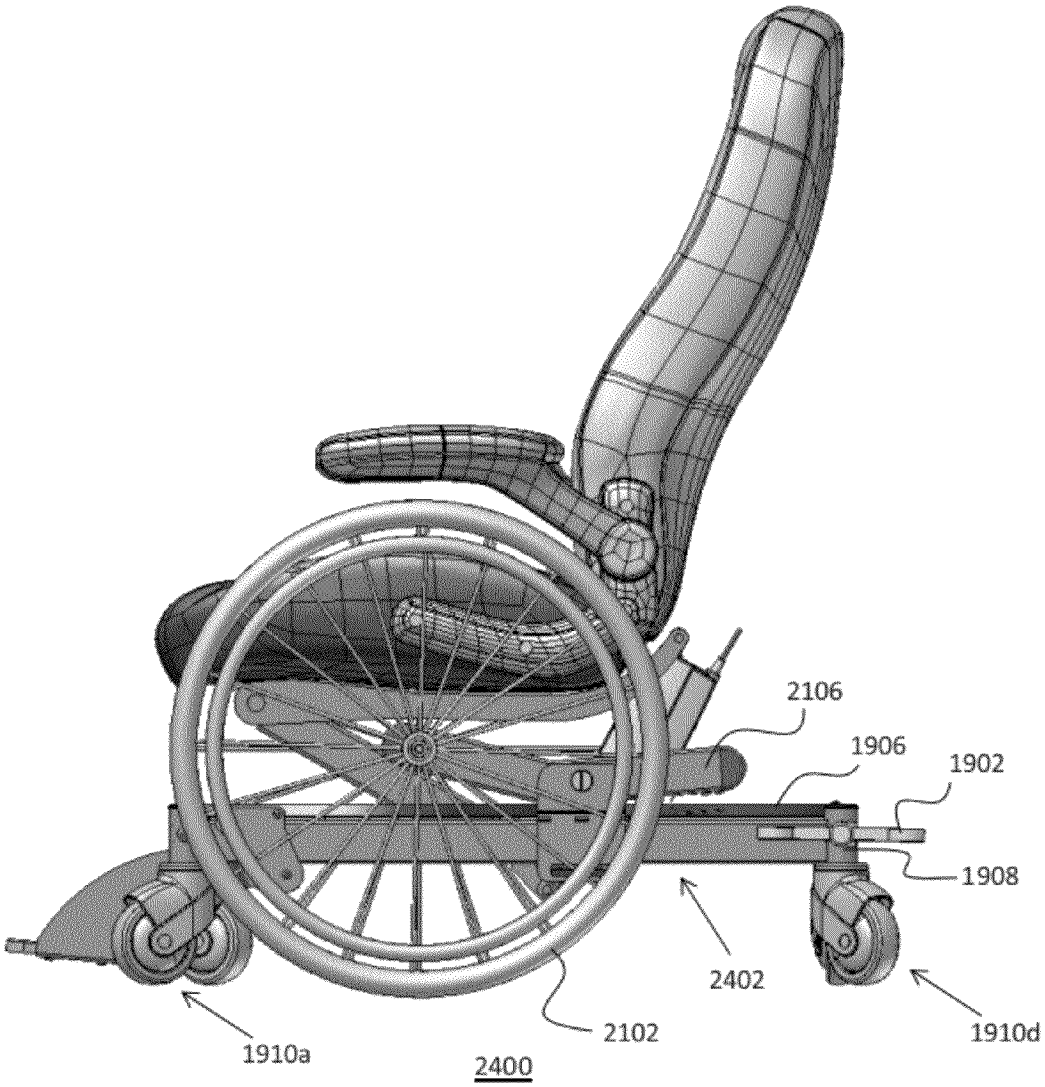
FIG. 27 is an elevational left side view of a mobile patient rocking chair assembly with a left wheelchair wheel coupled to a pivot arm that is attached to the frame of the mobile patient rocking chair assembly in accordance with the present invention.

FIG. 27 provides an elevational left side view of the patient rocking chair assembly 2400 with a left wheel chair wheel 2102 coupled to the undercarriage 2402 through a left spring-loaded pivot arm 2106. FIG. 27 also shows the undercarriage 2402 provided with a left foot lever 1902 coupled to and running through an upper control portion 1908 of the caster 1910*d*. In addition, FIG. 27 shows a left wheel-coupling rod 1906 coupling the upper control portion 1908 of the rear caster 1910*d* to a front caster 1910*a*. As was explained with regard to the embodiment shown in FIGS. 15-22, activation of the left foot lever 1902 in a first direction causes the rear caster 1910*d* to lock up and simultaneously, due to a corresponding movement of the left wheel coupling rod 1906, the front caster 1910*a* also locks and prevents movement of the patient rocking chair assembly 2400.

Figure 28:
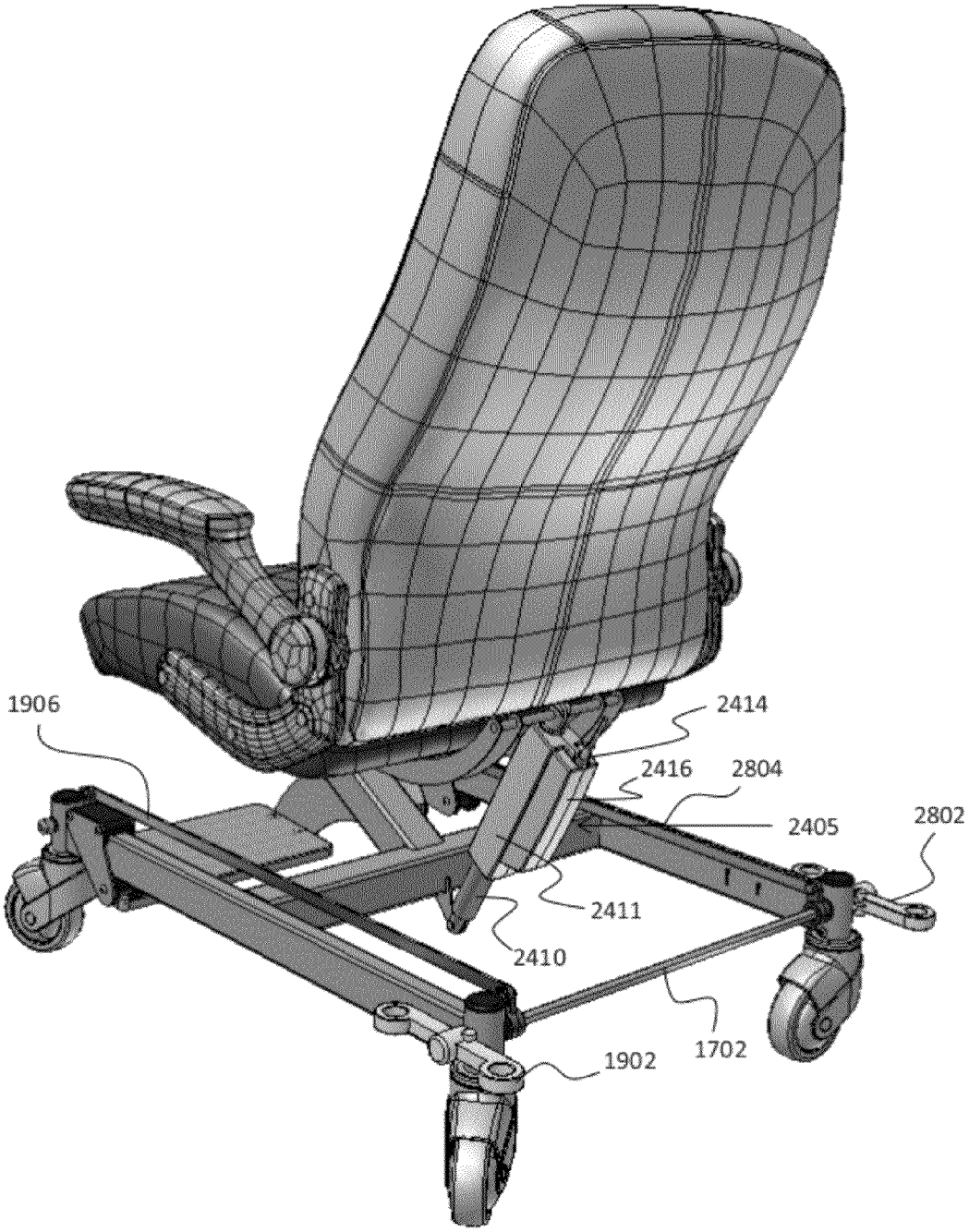
FIG. 28 is a perspective left rear view of the mobile patient chair assembly of FIG. 24 and illustrates an actuator for selecting a decline angle of the chair and foot levers that manipulate a frame bar to lock one or more of the casters upon which the mobile patient chair assembly receives movement capabilities in accordance with the present invention.

FIG. 28 provides a perspective left rear view of the patient rocking chair assembly 2400 and shows the left wheel-coupling rod 1906 and a right wheel-coupling rod 2804 in more detail. The left wheel coupling rod 1906 and the right wheel coupling rod 2804 are activated by rotation of the frame bar 1702, which itself is activated by either the left foot lever 1902 or a right foot lever 2802. FIG. 28 also provides a perspective view of the actuator 2405.

Figure 29:
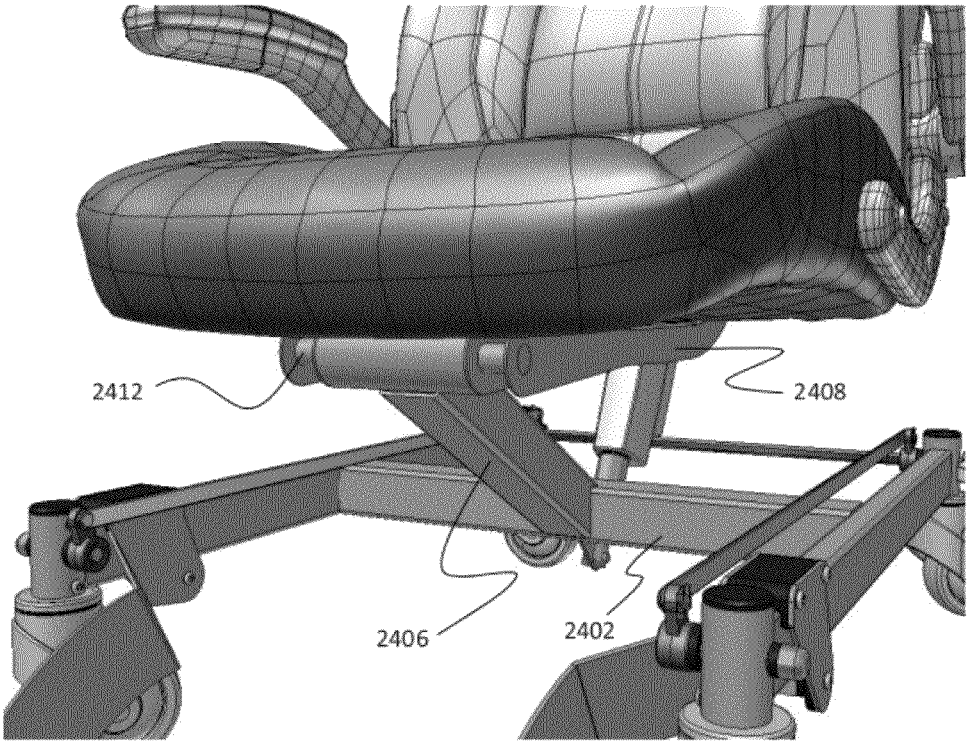
FIG. 29 is a perspective close-up partial front view of the mobile patient chair assembly of FIG. 24.
Figure 30:
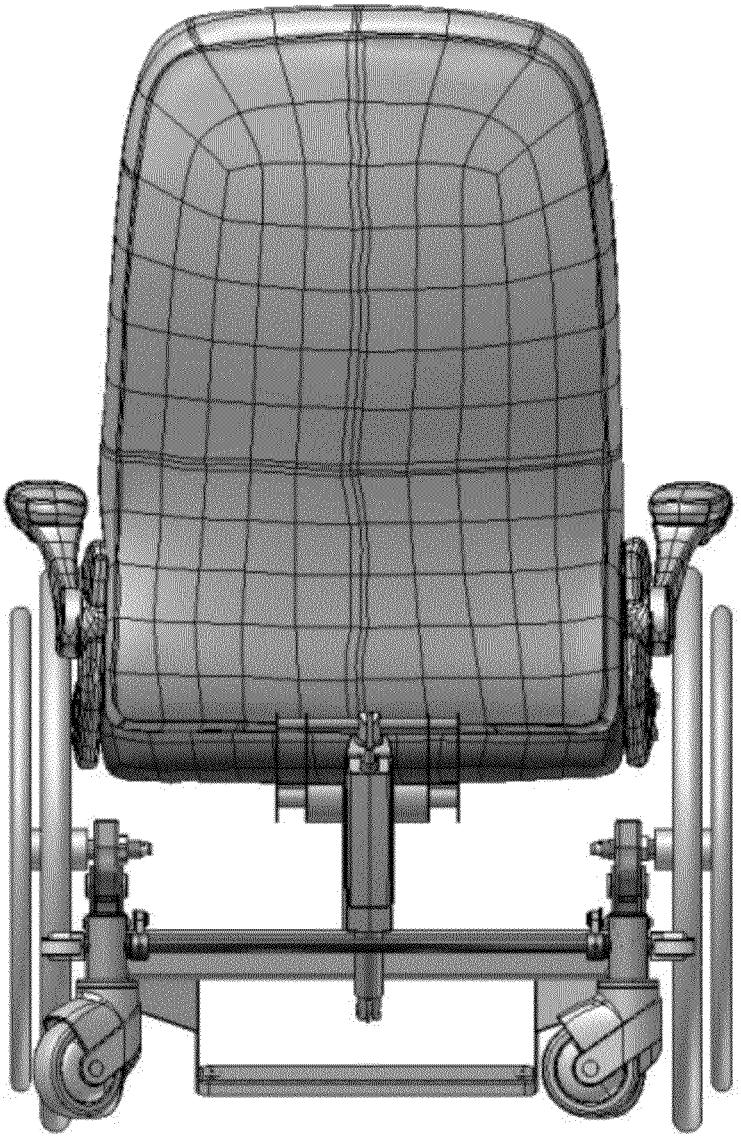
FIG. 30 is an elevational rear view of the mobile patient chair assembly of FIG. 24.
Figure 31:
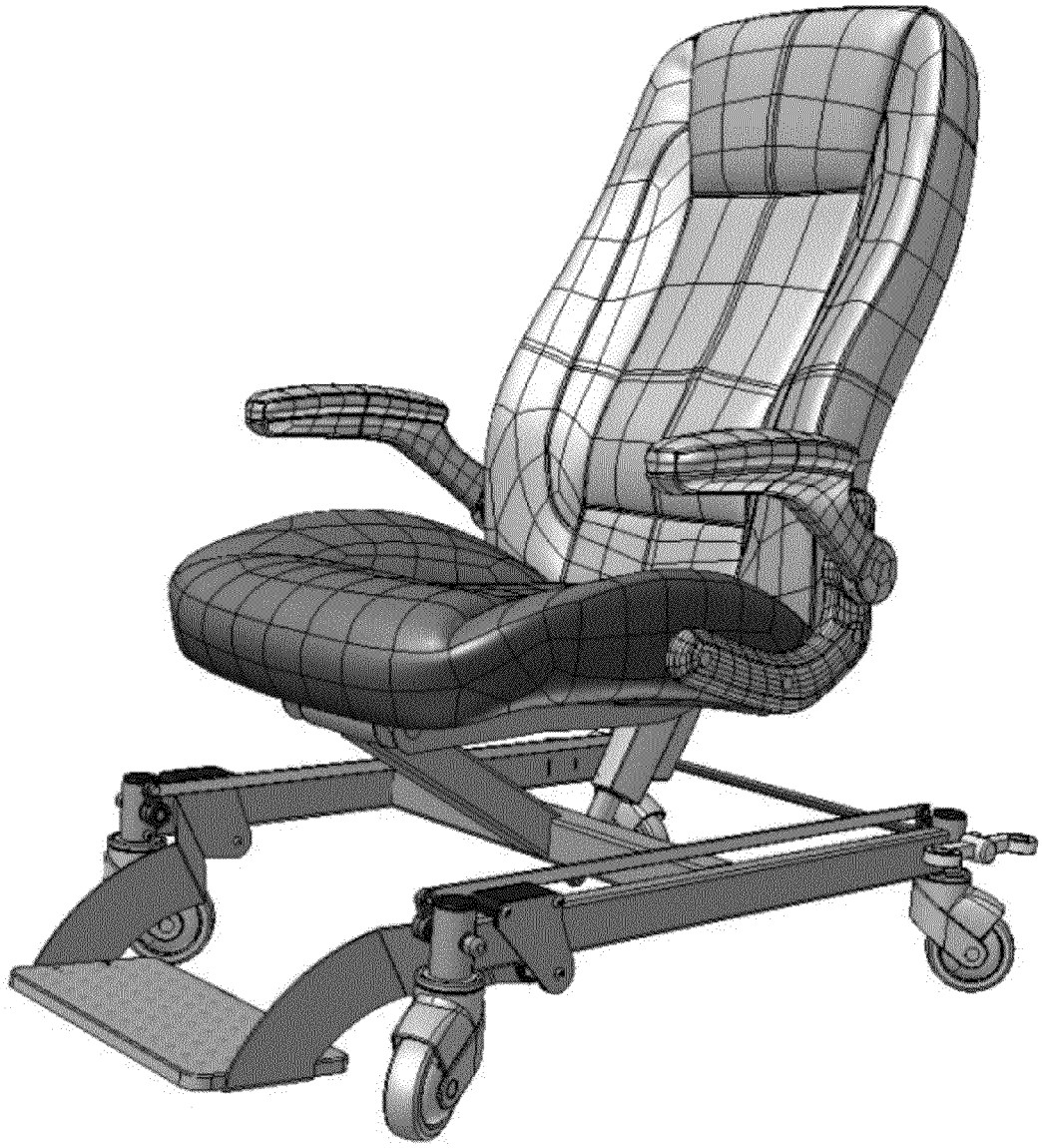
FIG. 31 is a perspective left front view of the mobile patient chair assembly of FIG. 24.

FIG. 29 provides a perspective left front view of the mobile patient rocking chair assembly 2400. FIG. 29 provides a clear view of the front frame brace 2406 and the upper pivoting member 2408, which are coupled to each other at pivot point 2412.

An inventive mobile patient rocking chair has been described that provides multiple unique self-activating features for physical and mental well-being. Embodiments of the invention provide a mobile chair capable of producing a gentle rocking motion that can, among other things, increase cardio vascular circulation and relieve pressure points for a patient which can produce the benefit of for example, prevent decubitus ulcers ("bed sores"). The present invention further provides an ergonomically shaped high backrest that is ideal for individuals who find it necessary or desirable to remain seated for extended time periods. The present invention is further capable of featuring attachable/detachable quick release wheelchair wheels for a patient's increased sense of mobility and independence. The wheelchair wheels can easily be removed to facilitate lateral transfers, even when a person is occupying the chair. Further advantages are realized through use of optional lower and/or upper body training features that provide increased physical and mental well-being. Hinged, foldable armrests allow for easy lateral transfer in and out of the chair and a central wheel locking provides increased safety and ease of operation, including automatic locking of the rocking mechanism when the wheels are unlocked. The inventive chair, in accordance with one embodiment, can be locked in five different comfortable tilt positions. Furthermore, a sliding footrest provides easy entrance to the chair and easy departure from the chair, while a height adjustable head rest provides increased comfort and neck support. A washable incontinence protection cover can be utilized that features optional, e.g., 30 mm, memory foam for increased comfort. A washable comfort seat cushion with, e.g., 30 mm, memory foam can also be included for increased comfort as can a washable comfort armrest cover with, e.g., 20 mm, memory foam for increased comfort.

What is claimed is:

1. A mobile patient chair comprising:

a seat portion; and an undercarriage coupled to and supporting the seat portion, the undercarriage including:

a frame having at least one selectively rolling wheel;

a rocking mechanism coupling the seat portion to the frame and operable to move the seat in a substantially forward and backward translating movement relative to the frame; and a lockout member having:

a first position that prevents a rolling ability of the at least one selectively rolling wheel and does not prevent the rocking mechanism from the substantially forward and backward translating movement relative to the frame; and a second position that does not inhibit the rolling ability of the at least one selectively rolling wheel and does prevent the rocking mechanism from the substantially forward and backward translating movement relative to the frame.

2. The mobile patient chair according to claim 1, wherein:

the first position and the second position of the lockout member are selectable by activation of a single lever.

3. The mobile patient chair according to claim 2, wherein:

the single lever is a foot pedal.

4. The mobile patient chair according to claim 1, wherein:

the at least one selectively rolling wheel is a set of four wheels operable to reduce friction between the frame and a flooring surface upon which the mobile patient chair is supported.

5. The mobile patient chair according to claim 1, wherein:

the first position of the lockout member also prevents a steering ability of the at least one selectively rolling wheel.

6. The mobile patient chair according to claim 1, wherein:

the rocking mechanism includes a lockout plate defining an aperture; and the lockout member has an engagement member shaped to fit within the aperture when the lockout member is in the second position.

7. The mobile patient chair according to claim 1, further comprising:

a frame bar coupled to the at least one selectively rolling wheel and to the lockout member, wherein an axial rotation of the frame bar moves the lockout member between the first position and the second position.

8. The mobile patient chair according to claim 7, further comprising:

a foot activatable lever coupled to the frame bar and operable to cause the axial rotation of the frame bar in response to receiving a force from a foot.

9. A mobile patient chair comprising:

a seat portion; and an undercarriage coupled to and supporting the seat portion, the undercarriage including:

a frame having a set of rollers; and a rocking mechanism coupling the seat portion to the frame;

a rolling mode, whereby the set of rollers rotate and allow the mobile patient chair to move from a first location to a second location;

a rocking mode, whereby the rocking mechanism is operable to move the seat in a substantially forward and backward translating movement relative to the frame; and a lockout member rendering the rolling mode and the rocking mode mutually exclusive.

10. The mobile patient chair according to claim 9, wherein:

the lockout member has:

a first position that prevents a rolling ability of the set of rollers and does not prevent the rocking mechanism from the substantially forward and backward translating movement relative to the frame; and a second position that does not inhibit the rolling ability of the set of rollers and does prevent the rocking mechanism from the substantially forward and backward translating movement relative to the frame.

11. The mobile patient chair according to claim 10, wherein:

the first position and the second position of the lockout member are selectable by activation of a single lever.

12. The mobile patient chair according to claim 11, wherein:

the single lever is a foot pedal.

13. The mobile patient chair according to claim 10, wherein:

the first position of the lockout member also prevents a steering ability of at least one of the set of rollers.

14. The mobile patient chair according to claim 10, further comprising:

a frame bar coupled to at least one of the set of rollers and to the lockout member, wherein an axial rotation of the frame bar moves the lockout member between the first position and the second position.

15. The mobile patient chair according to claim 14, further comprising:

a foot activatable lever coupled to the frame bar and operable to cause the axial rotation of the frame bar in response to receiving a force from a foot.

16. The mobile patient chair according to claim 9, wherein:

the set of rollers is a set of four wheels operable to reduce friction between the frame and a flooring surface upon which the mobile patient chair is supported.

17. The mobile patient chair according to claim 9, wherein:

the rocking mechanism includes a lockout plate defining an aperture; and the lockout member has an engagement member shaped to fit within the aperture when the mobile patient chair is in the rocking mode.

18. A method for selecting between modes of a mobile patient rocking chair comprising:

providing a mobile patient rocking chair, including:

a seat portion; and an undercarriage coupled to and supporting the seat portion, the undercarriage including:

a frame having a set of rollers; and a rocking mechanism coupling the seat portion to the frame; and selecting between a rolling mode, whereby the set of rollers rotate and allow the mobile patient rocking chair to move from a first location to a second location and a rocking mode, whereby the rocking mechanism is operable to move the seat in a substantially forward and backward translating movement relative to the frame by activation of a single member, whereby the rolling mode and the rocking mode are mutually exclusive.

19. The method according to claim 18, wherein:

the selecting between the rolling mode and the rocking mode is performed by providing a force from a user's foot.

* * * * *